US011322839B2

(12) United States Patent
Dastjerdi et al.

(10) Patent No.: US 11,322,839 B2
(45) Date of Patent: May 3, 2022

(54) METHOD AND APPARATUS FOR IMPLEMENTING REFLECTION TYPE PHASE SHIFTERS (RTPS) IN A COMMUNICATION SYSTEM

(71) Applicant: Mixcomm, Inc., Chatham, NJ (US)

(72) Inventors: Mahmood Baraani Dastjerdi, Irvington, NJ (US); Arun Natarajan, Corvallis, OR (US); Harish Krishnaswamy, New York, NY (US)

(73) Assignee: Mixcomm, Inc., Chatham, NJ (US)

( * ) Notice: Subject to any disclaimer, the term of this patent is extended or adjusted under 35 U.S.C. 154(b) by 119 days.

(21) Appl. No.: 16/888,723

(22) Filed: May 30, 2020

(65) Prior Publication Data

US 2021/0376465 A1 Dec. 2, 2021

(51) Int. Cl.

| | |
|---|---|
| ***H01Q 3/38*** | (2006.01) |
| ***H01P 1/18*** | (2006.01) |
| ***H01P 5/04*** | (2006.01) |

(52) U.S. Cl.

CPC ..... *H01Q 3/38* (2013.01); *H01P 1/18* (2013.01); *H01P 5/04* (2013.01)

(58) Field of Classification Search

CPC ... H01P 1/184; H01P 1/18; H01P 5/04; H01Q 3/38

USPC ..... 333/138, 139, 168, 169, 170

See application file for complete search history.

(56) References Cited

U.S. PATENT DOCUMENTS

| | | | | |
|---|---|---|---|---|
| 10,270,146 | B2 * | 4/2019 | Du | H03H 7/185 |
| 2009/0278624 | A1 | 11/2009 | Tsai et al. | |
| 2014/0159818 | A1 | 6/2014 | Jeon et al. | |
| 2019/0207288 | A1 | 7/2019 | Zhu et al. | |
| 2019/0296718 | A1 | 9/2019 | Birkbeck et al. | |
| 2019/0319681 | A1 | 10/2019 | Natarajan et al. | |

OTHER PUBLICATIONS

International Search Report and Written Opinion of the International Searching Authority from PCT/US2021/033800, dated Oct. 18, 2021, 1-11 pages.

(Continued)

*Primary Examiner* — Rakesh B Patel
*Assistant Examiner* — Jorge L Salazar, Jr.
(74) *Attorney, Agent, or Firm* — Straub & Straub; Michael P. Straub; Stephen T. Straub

(57) ABSTRACT

A controllable reflection type phase shifter that includes an adjustable hybrid coupler and controllable adjustable reflection load circuit is described and used in some embodiments to implemented a communication system. In some embodiments the communication system supports beam forming through the use of a plurality of TX/RX signal processing chains (SPCs), each SPC including at least one reflection type phase shifter, e.g., a controllable reflection type phase shifter. The controllable reflection type phase shifters in different SPCs of the array are configured, e.g., differently, based on the particular beam pattern being used to transmit or receive signals at a given time. Control information, e.g., control values, are stored in memory with the control values corresponding to an antenna pattern to be used at a given time being retrieved from memory and to control the circuits, e.g., controllable reflection type phase shifters, in the system.

20 Claims, 12 Drawing Sheets

(56) References Cited

OTHER PUBLICATIONS

10 Phased Array Beamforming ICSs Simplify Antenna Designs, AnalogDialogue Your Engineering Resource for Innovative Design, Nov. 1, 2019, vol. 53, pp. 1-56.
Frank Ellinger, Rolf Vogt and Werner Bachtold, Ultracompact Reflective-Type Phase Shifter MMIC at C-Band With 360° Phase-control Range for Smart Antenna Combining, IEEE Journal of Solid-State Circuits, Apr. 2002, vol. 37, No. 4, pp. 481-486.
Timothy M. Hancock and Gabriel M. Rebeiz, A 12-GHz SiGe Phase Shifter With Integrated LNA, IEEE Transactions on Microwave Theory and Techniques, vol. 53, No. 3 Mar. 2005, pp. 977-983.
Ta-Shun Chu, Jonathan Roderick, Hossein Hashemi, A 4-Channel UWB Beam-Former in 0.13μm CMOS using a Path-Sharing True-Time-Delay Architecture, IEEE International Solid-State Circuits Conference, Session 23, Broadbank RF and Radar, 23.5, Feb. 14, 2007, pp. 426, 427 and 613.
Jong-Wook Lee and Seong-Yeon Kim, 60 GHz switched-line-type phase shifter using body-floating switches in 0.13 μm COS technology, Electronics Letters, vol. 48, No. 7, Mar. 29, 2012, 2 pages.

* cited by examiner

399

224

$$\Delta\varphi = \angle \frac{Z_T - Z_H}{Z_T + Z_H} - 90^o$$

225

METHOD AND APPARATUS FOR IMPLEMENTING REFLECTION TYPE PHASE SHIFTERS (RTPS) IN A COMMUNICATION SYSTEM

FIELD

The present application relates to beamforming methods and apparatus, and more particularly, to improved reflection type phase shifter (RTPS) methods and apparatus.

BACKGROUND

A phase shifter is desired for beamforming applications. A passive phase shifter is desired due to its superior linearity, zero DC power consumption and bidirectional feature for TX/RX switchable transceiver. Typically there is amplitude and phase control line each element in a beamformer, and thus minimum gain variation is desired for the total phase shift range.

There are multiple structures for passive phase shifters such as: switched T-line, travelling-wave true-time-delay, loaded line (Tunable T-line) and traditional reflection-type (RTPS). The switched T-line passive phase shifter structure has the disadvantages of large step (coarse resolution) and requires multiple T-lines which lead to excessive chip area. The travelling-wave true-time-delay passive phase shifter structure has the disadvantages of high loss and requires a large area, e.g. large chip area, for implementation. The loaded line (tunable T-line) passive phase shifter structure has the disadvantages of large area due to plenty inductors and high loss due to multiple series lossy varactors.

In the traditional simple reflection-type passive phase shifter structure a fixed impedance value 3 dB 90° coupler is used with two identical low order reflective load networks. Typically each low order reflective load network includes two varactors (voltage controlled variable capacitor C1, voltage controlled variable capacitor C2) and an inductor (L1) coupled together. Each of the elements also has an intrinsic series resistance which effects operation. Traditionally the values of capacitors C1 and C2 within each of the reflection loads are varied with the same control voltage, and this results in large loss variation with phase shift.

One option to overcome this problem of large loss variation with phase shift characteristic of the simple traditional reflection-type passive phase shifter structure with low order reflective load networks, is to use a higher order network for each reflective load network, e.g. a reflective load network including three inductors and three capacitors. The disadvantages of using higher order networks for reflective loads results in the cost of higher loss vs. phase range and the need to for a larger area, e.g. larger circuit board area, to implement the higher order reflective load networks.

Thus, based on the discussion above there is a need for new methods and apparatus for a phase shifter in beamforming applications and/or for using new phase shifters in a communications system.

SUMMARY

Various methods and apparatus are directed to an improved reflection type phase shifter. An exemplary improved reflection type phase shifter, in accordance with some embodiments, is a controllable reflection type phase shifter including a controllable adjustable hybrid coupler and controllable adjustable reflection load circuits. In some such embodiments, each reflection type load circuit is a low order reflective load network but includes independent control lines for independently controlling two varactors. A communication system used in beamforming includes a plurality of TX/RX signal processing chains (SPCs), each SPC including one of these improved reflection type phase shifters. The reflection type phase shifters are used in a communications system in some embodiments.

Sets of control information are determined and stored, e.g. in a look-up table, for controlling each of the controllable reflection type phase shifters to be set to achieve a desired amount of phase shift corresponding to a beam angle to be used. An exemplary set of stored control information for controlling an adjustable hybrid coupler of the controllable reflection type phase shifter includes information used: to control adjustable capacitor values, to control adjustable inductor value settings, and/or to control transmission line switch settings, to achieve a desired impedance ZH of the adjustable hybrid coupler. An exemplary set of stored control information for controlling an adjustable reflective load of the controllable reflection type phase shifter includes information used to control adjustable capacitor values to achieve a desired impedance ZT of the adjustable reflective load.

A controller controlling a reflection type phase shifter retrieves, based on the beam angle to be used and the particular SPC being configured, stored information, e.g. from a look-up table, and uses the stored information to generate control signals which as sent to the controllable reflection type phase shifter of the particular SPC. The controllable reflection type phase shifter configures itself, in accordance with the received information, achieving desired values for ZH and ZT and thus setting its phase shift at the desired amount of phase shift for the beam direction to be used.

The controllable reflection type phase shifter in each of the TX/RX signal processing chains in an array of SPCs is configured, e.g. differently, to achieve the desired amount of phase shift for that particular SPC and beam direction. Then, multiple SPCs, which have been configured, e.g., differently, for the beam direction, are operated in parallel to send or receive data.

If beam direction is to be changed, the controllable reflection type phase shifters are re-configured, by the controller, to achieve the desired phase shifts corresponding to the new beam direction.

An exemplary communication system, in accordance with some embodiments, comprises: a first controller for generating an impedance control signal and multiple phase shift control signals; a first signal processing chain including: a first controllable impedance having a first impedance control input coupled to said controller; a first controllable reflection type phase shifter coupled to the first controllable impedance and having one more phase shift control inputs coupled to said controller for receiving multiple phase shift control values (e.g., capacitance control values, inductance control values and/or switch setting control values) from said controller; a first amplifier circuit coupled to the first controllable reflection type phase shifter; and a first antenna element coupled to the first amplifier circuit.

An exemplary method, in accordance with various exemplary embodiments, comprises: determining, for a first processing chain, a first phase shift corresponding to a first selected beam direction; determining, for the first processing chain, a first value for a hybrid impedance (ZH) of a adjustable hybrid coupler and a first value for a reflective load impedance (ZT) of a reflective load based on the first phase shift and controllable ranges of ZH and ZT; determining, for the first processing chain, a first set of control values for controlling the adjustable hybrid coupler of the first processing chain to be set at the determined first value of ZH; determining, for the first processing chain, a first set of control values for controlling loads in reflective load circuitry of the first processing chain to be set at the determined first value of ZT; storing (e.g., in a look-up table) said determined first set of control values for controlling the adjustable hybrid coupler in the first processing chain to be set at the first determined value of ZH; and storing (e.g., in the look-up table) and said determined first set of control values for controlling loads in reflective load circuitry in the first processing chain to be set at the first determined value of ZT.

An exemplary method, in accordance with some embodiments, comprises: receiving information indicating a beam direction to be used (e.g., a beam direction which has been selected for transmission or reception purposes); retrieving a first set of stored control signal setting information corresponding to the beam direction and a first signal processing chain to set an adjustable hybrid coupler in the first signal processing chain at a first desired value of ZH; generating first control signals to be sent to the adjustable hybrid coupler of the first signal processing chain; sending the generated first control signals to the adjustable hybrid coupler of the first signal processing chain; configuring the adjustable hybrid coupler of the first signal processing chain based on the first received control signals; and operating the first signal processing chain to transmit or receive.

While various features discussed in the summary are used in some embodiments it should be appreciated that not all features are required or necessary for all embodiments and the mention of features in the summary should in no way be interpreted as implying that the feature is necessary or critical for all embodiments.

Numerous additional features and embodiments are discussed in the detailed description which follows.

BRIEF DESCRIPTION OF THE FIGURES

FIG. 11 comprises the combination of FIG. 11A and FIG. 11B.

DETAILED DESCRIPTION

Figure 1:
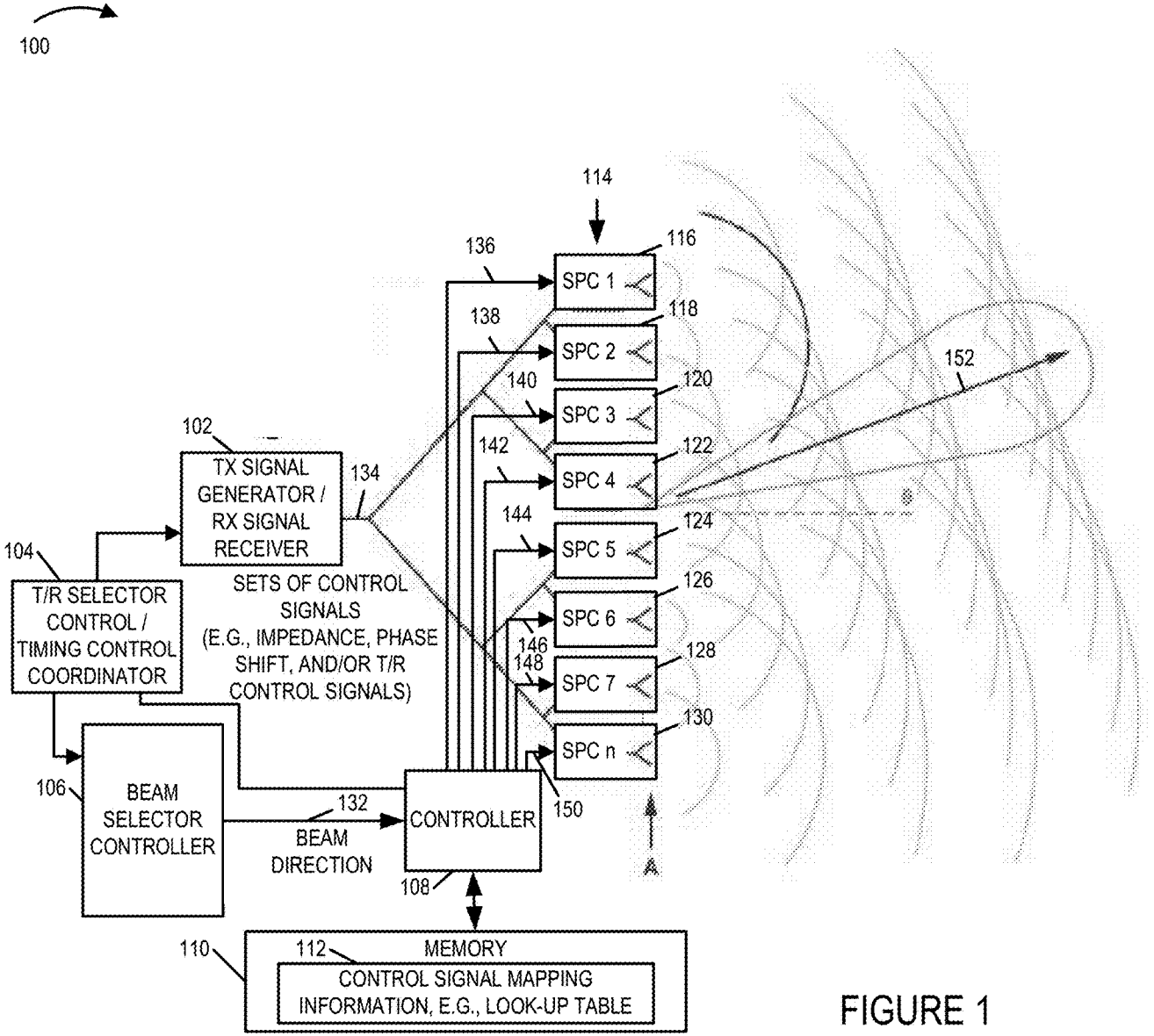
FIG. 1 is a drawing of an exemplary communication system in accordance with an exemplary embodiment.

FIG. 1 is a drawing of an exemplary communications system 100 in accordance with an exemplary embodiment. Exemplary communications system 100 in some embodiments is system which support transmission of signals and thus will sometimes be referred to as a transmission system. However, since the communications system 100 includes a receiver circuitry it is also a receiver system. In the example shown in FIG. 1 system 100 includes TX signal generator/RX signal receiver 102, a transmit/receive (T/R) selector control/timing control coordinator 104, a beam selector controller 106, a controller 108, memory 110, and an array 114 of signal processing chains (SPCs), coupled together as shown.

While explained in the context of an exemplary time divisions duplex (TDD) embodiment in which switching between transmit and receive modes of operation occur, many of the features discussed in the present application are also applicable to frequency duplex (FDD) systems in which different frequencies are used for transmitting and receiving signals. In FDD embodiments the switch for switching between receive and transmit modes of operation with different frequencies and/or components being used to support transmit and receive functions at the same time.

The array of signal processing chains 114 includes a plurality of signals processing chains (SPC 1 116, SPC 2 118, SPC 3 120, SPC 4 122, SPC 5 125, SPC 6 126, SPC 7 128, . . . , SPC n 130). Each of the signals processing chains (116, 118, 120, 122, 124, 126, 128, . . . , 130) includes a controllable impedance, e.g., a controllable resistance, a controllable reflection type phase shifter, a TX/RX amplifier circuit, switches for switching between transmit (TX) and receive (RX), and antenna element.

Memory 110 includes control signal mapping information 112, e.g., a look-up table.

The TX signal generator of TX signal generator/RX signal receiver unit 102, while controlled by T/R selector control/timing control coordinator 104 to operate in transmit mode, generates transmit signals 134 which are sent as input to each of the SPCs. The RX signal receiver of TX signal generator/RX signal receiver unit 102, while controlled by T/R selector control/timing control coordinator 104 to operate in receive mode, receives, as input receive signals 134 which are a composite of processed receive signals from the SPCs.

Beam selector controller 106, operating under the direction of the T/R selector control/timing control coordinator 104, selects a beam direction, e.g., from among a plurality of alternative beam directions, to be used at a particular time, generates a beam direction signal, and sends the beam direction signal 132 to the controller 108.

Controller 108 receives transmit/receive control information, e.g., indicating receive or transmit, and timing information, e.g., indicating switching times between T/R settings, switching times between beam direction changes, durations to remain in transmit or receive, duration to remain at a particular beam direction setting, and/or times corresponding to each beam direction setting. Controller 108 also receives beam direction signal 132, indicating a beam direction to be used, from beam direction controller 106. Controller 108 retrieves control signal mapping information 112, e.g., corresponding to the indicated beam direction, from memory 110, e.g., receives sets of control information used to generate control signals to be sent to each of the SPCs to configure the SPCs for a particular beam direction. Arrow 152 identifies one exemplary beam direction. An exemplary set of control signals to be sent to a SPC includes, e.g., impedance control signal(s), phase shift control signals, and/or T/R control signals.

Set of control signals 136 is generated and sent by controller 108 to SPC 1 116. Set of control signals 138 is generated and sent by controller 108 to SPC 2 118. Set of control signals 140 is generated and sent by controller 108 to SPC 3 120. Set of control signals 142 is generated and sent by controller 108 to SPC 4 122. Set of control signals 144 is generated and sent by controller 108 to SPC 5 124. Set of control signals 146 is generated and sent by controller 108 to SPC 6 126. Set of control signals 148 is generated and sent by controller 108 to SPC 7 128. Set of control signals 150 is generated and sent by controller 108 to SPC n 130.

In FIG. 1, controller 108 is shown as being external to the signals processing chains. In some embodiments, each of the signals processing chains in the array 114 of signal processing chains includes its own controller, similar to controller 108, which generates control signals to control elements within its own signal processing chain.

Figure 2:
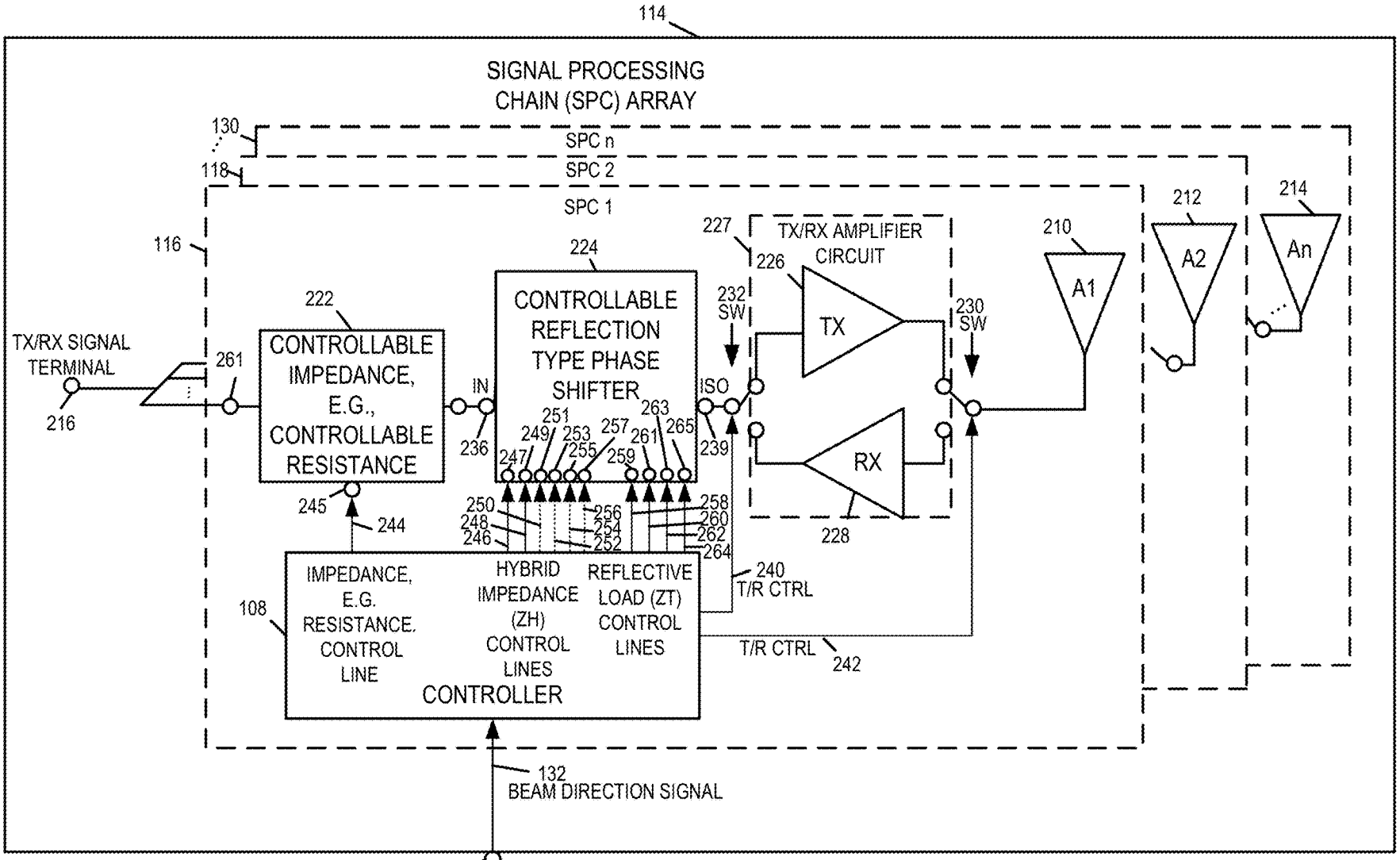
FIG. 2 is a drawing of an exemplary signal process chain (SPC) array in accordance with an exemplary embodiment.

FIG. 2 is a drawing of an exemplary signal process chain (SPC) array 114 in accordance with an exemplary embodiment. Signal processing array 114 includes a plurality of signal processing chains (SPC 1 116, SPC 2 118, . . . SPC n 130). SPC 1 116 includes a controller 108, a controllable impedance 222, e.g., a controllable resistance, a controllable reflection type phase shifter 224, a TX/RX amplifier circuit 227, controllable transmit receive (T/R) switches 222, 230, and antenna element A1 210 coupled together as shown. SPC 2 118 includes a controller, a controllable impedance, e.g., a controllable resistance, a controllable reflection type phase shifter, a TX/RX amplifier circuit, controllable transmit receive (T/R) switches and antenna element A2 210 coupled together. SPC n 130 includes a controller, a controllable impedance, e.g., a controllable resistance, a controllable reflection type phase shifter, a TX/RX amplifier circuit, controllable transmit receive (T/R) switches and antenna element An 214 coupled together.

The signal processing array 114 includes a TX/RX signal terminal 216, which is coupled to a TX/RX receive terminal of each SPC including TX/RX signal terminal 261 if SPC 1 116. The signal processing array 114 further includes a beam direction terminal 218, which is coupled to an input of the controller in each SPC including controller 108 of SPC 1 106.

Controller 108 generates impedance, e.g. resistance, control line signal 244 which is sent to input terminal 245 of controllable impedance 245 to configure the controllable impedance 222, e.g., a controllable resistance, to be set at a desired value corresponding to a beam direction to be used. Controller 108 also generates and outputs hybrid impedance (ZH) control lines signals (246, 248, 250, 252, 254, 256) which are input to terminals (247, 249, 251, 263, 255, 257) of the controllable reflection type phase shifter 224 to configure an adjustable hybrid coupler to be set at a desired impedance ZH corresponding to a beam direction to be used. Controller 108 further generates and outputs reflective load (ZT) control lines signals (258, 260, 262, 264) which are input to terminals (259, 261, 263, 265) of the controllable reflection type phase shifter 224 to configure reflective loads within reflective load circuitry to be set at a desired impedance ZT corresponding to a beam direction to be used.

Controller 108 further generates and outputs T/R control line signals 240, 242 which are used to control the positions of switches 232, 230, respectively, to be set in either transmit or receive mode.

TX/RX amplifier circuit 227 includes a transmit amplifier 226 and a receive amplifier 228. When the SPC 1 116 is to be operated as a transmit chain, switch 232 is controllable set to couple the input of TX amplifier 226 to ISO terminal 239 of controllable reflection type phase shifter and switch 230 is controllable set to couple the output of TX amplifier 226 to antenna element A1. When the SPC 1 116 is to be operated as a receive chain, switch 230 is controllable set to couple antenna element A1 210 to the input of RX amplifier 228, and switch 230 is controllable set to couple the output of RX amplifier 228 to ISO terminal 239 of controllable reflection type phase shifter.

Controllable impedance 222, e.g., a controllable resistance, is used to control the amplitude (gain) of the signal to be transmitted on antenna element A1 210, said control being a function of the beam direction. Controllable reflection type phase shifter 224 is used to control the phase of the signal to be transmitted on antenna element A1, said control being a function of the beam direction.

Figure 3:
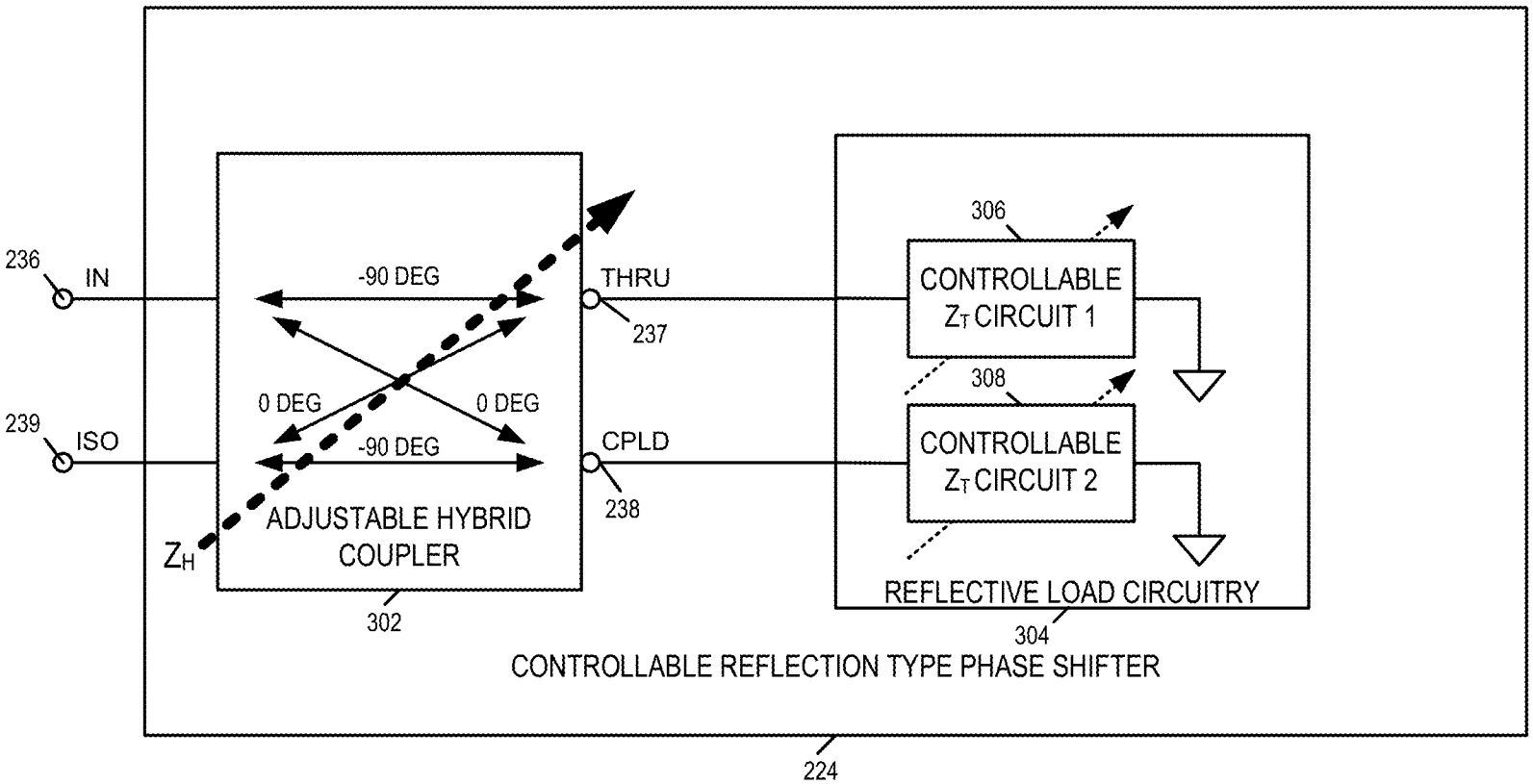
FIG. 3 is a drawing of an exemplary controllable reflection type phase shifter in accordance with an exemplary embodiment.

FIG. 3 is a drawing of an exemplary controllable reflection type phase shifter 224 in accordance with an exemplary embodiment. Controllable reflection type phase shifter 224 includes an adjustable hybrid coupler 302 and controllable reflective load circuitry 304 coupled together as shown. The adjustable hybrid coupler 302 includes an input (IN) terminal 236, an isolated output (ISO) terminal 239, a THRU terminal 237, an a coupled (CPLD) terminal 238. The reflective load circuitry 304 includes a controllable ZT circuit 1 306, which is coupled to THRU terminal 237 of adjustable hybrid coupler 302 and a controllable ZT circuit 2 308, which is coupled to CPLD terminal 238 of adjustable hybrid coupler 302. The impedance value of adjustable hybrid couple 302, which can be controllable set, is represented as ZH. The impedance value of each of the controllable load circuits (306, 308) which can be controllable set, is represented as ZT. IN terminal 236 of adjustable hybrid coupler 302 is also an interface terminal of the controllable reflection type phase shifter 224. ISO terminal 239 of adjustable hybrid coupler 302 is also an interface terminal of the controllable reflection type phase shifter 224.

Figure 4:
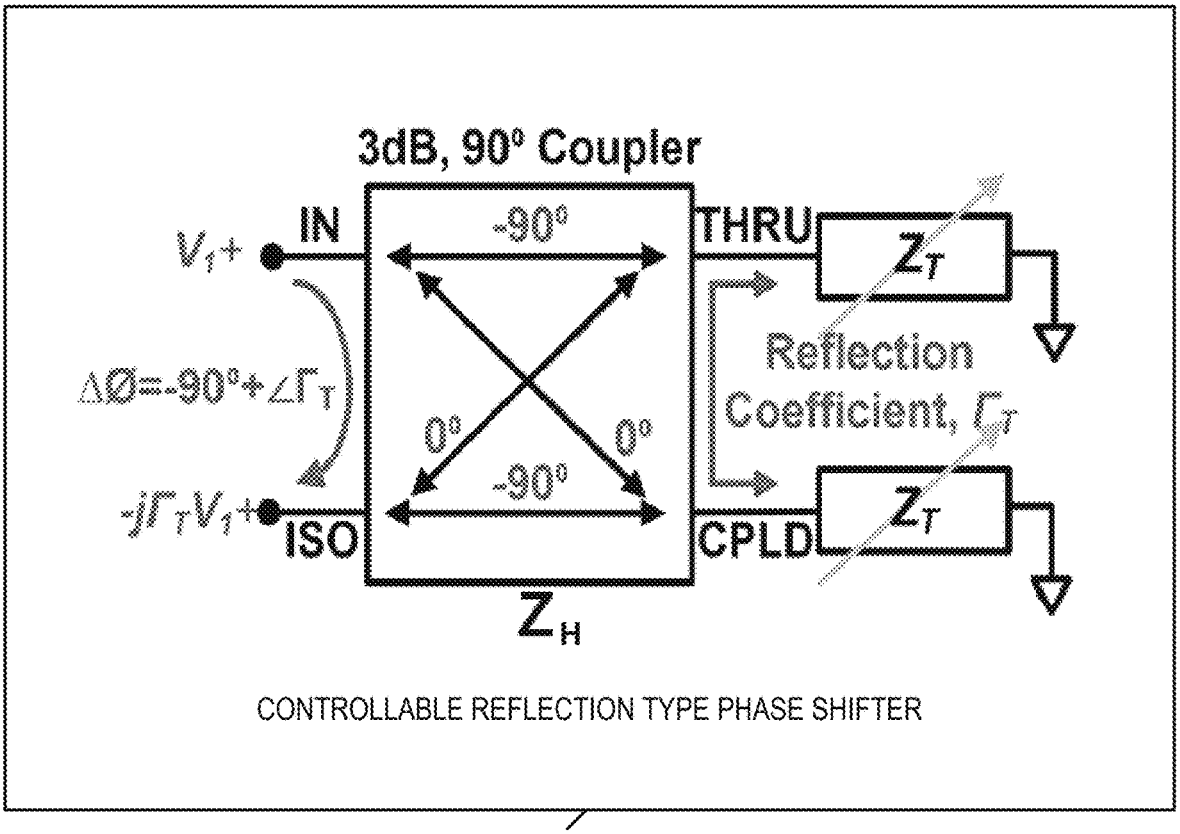
FIG. 4 includes a drawing illustrating a controllable reflection type phase shifter and phase shift equations corresponding to the reflection type phase shifter.

FIG. 4 includes a drawing 399 illustrating a controllable reflection type phase shifter 224 and a phase shift equation 225 corresponding to the reflection type phase shifter 224. The phase shift equation 225 shows the relationship between the achieved phase shift angle and the two controllable impedance values (Controllable Hybrid coupler impedance (ZH) and controllable reflective load impedance (ZT). ZH and ZT are controllable set to achieve a desired phase shift value for a particular beam direction.

Figure 5:
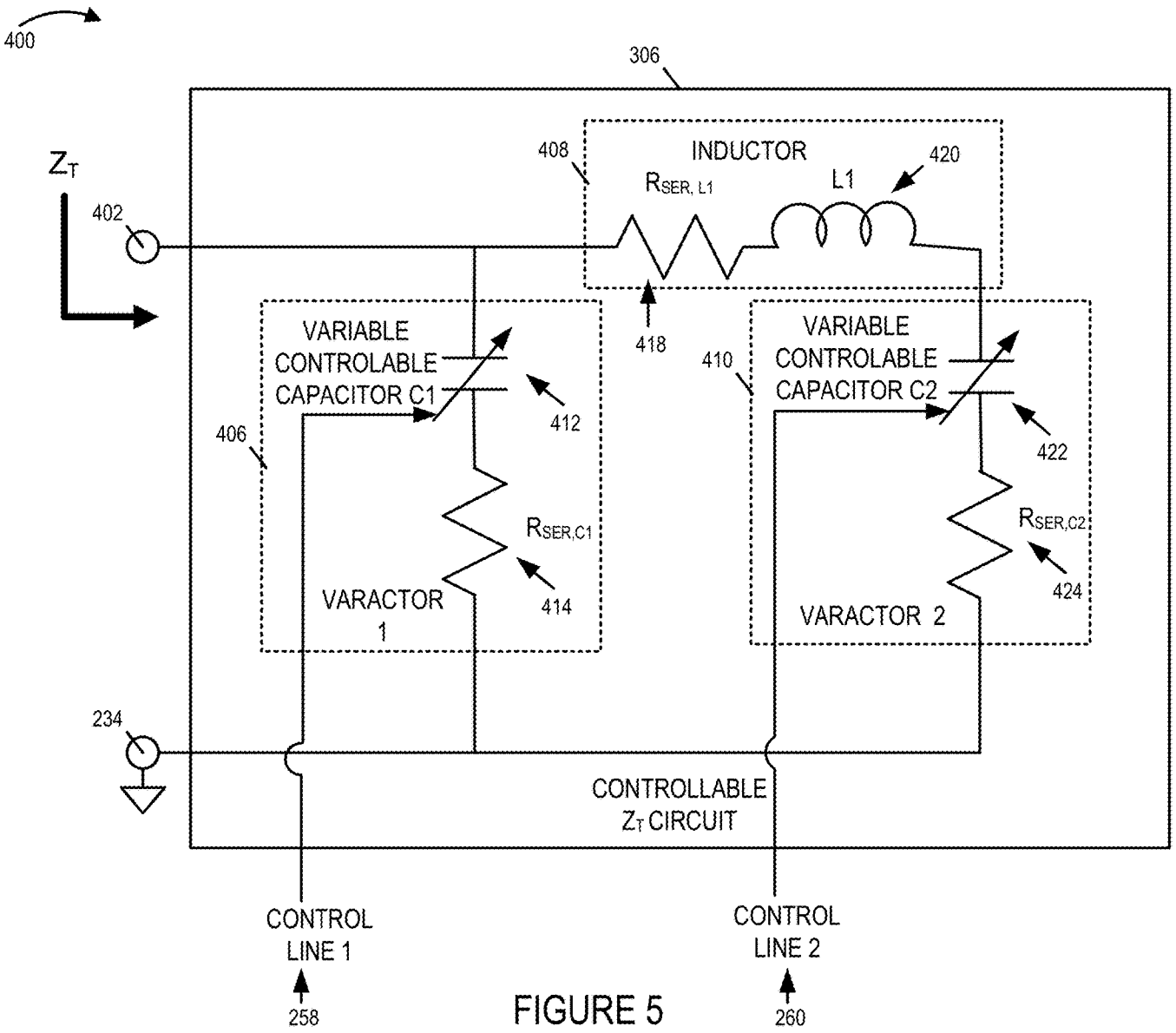
FIG. 5 is a drawing illustrating an exemplary controllable reflective load circuit, which may be included as part of a controllable reflection type phase shifter, in which each variable controllable capacitor of the controllable reflective load is controlled by a different control line signal in accordance with an exemplary embodiment.

FIG. 5 is a drawing illustrating 400 illustrating controllable reflective load circuit 306 in accordance with an exemplary embodiment. The input impedance of controllable reflective load circuit 306, across input terminal 402 and ground terminal 234, is ZT.

Controllable reflective load circuit 306 includes an inductor 408 and two varactors (varactor 1 406, varactor 2 410) coupled together as shown. Inductor 408 is represented as ideal inductor L1 420 and resistor (RSER,L1) 418. Varactor 1 406 is represented as variable control capacitor C1 412 in series with resistor (RSER,C1) 414. Varactor 2 410 is represented as variable control capacitor C2 422 in series with resistor (RSER,C2) 424. Controllable reflective load circuit 306 includes control line 1 258 which is coupled to varactor 1 406. Control line 1 258 receives, a control signal, e.g., a voltage signal, used to configured the value of capacitor C1. Controllable reflective load circuit 306 further includes control line 2 260 which is coupled to varactor 2 410. Control line 2 260 receives, a control signal, e.g., a voltage signal, used to configured the value of capacitor C2. The values of capacitors C1 412 and C2 410 are controlled to achieve an overall desired impedance value of ZT for the reflective load circuit 306.

Figure 6:
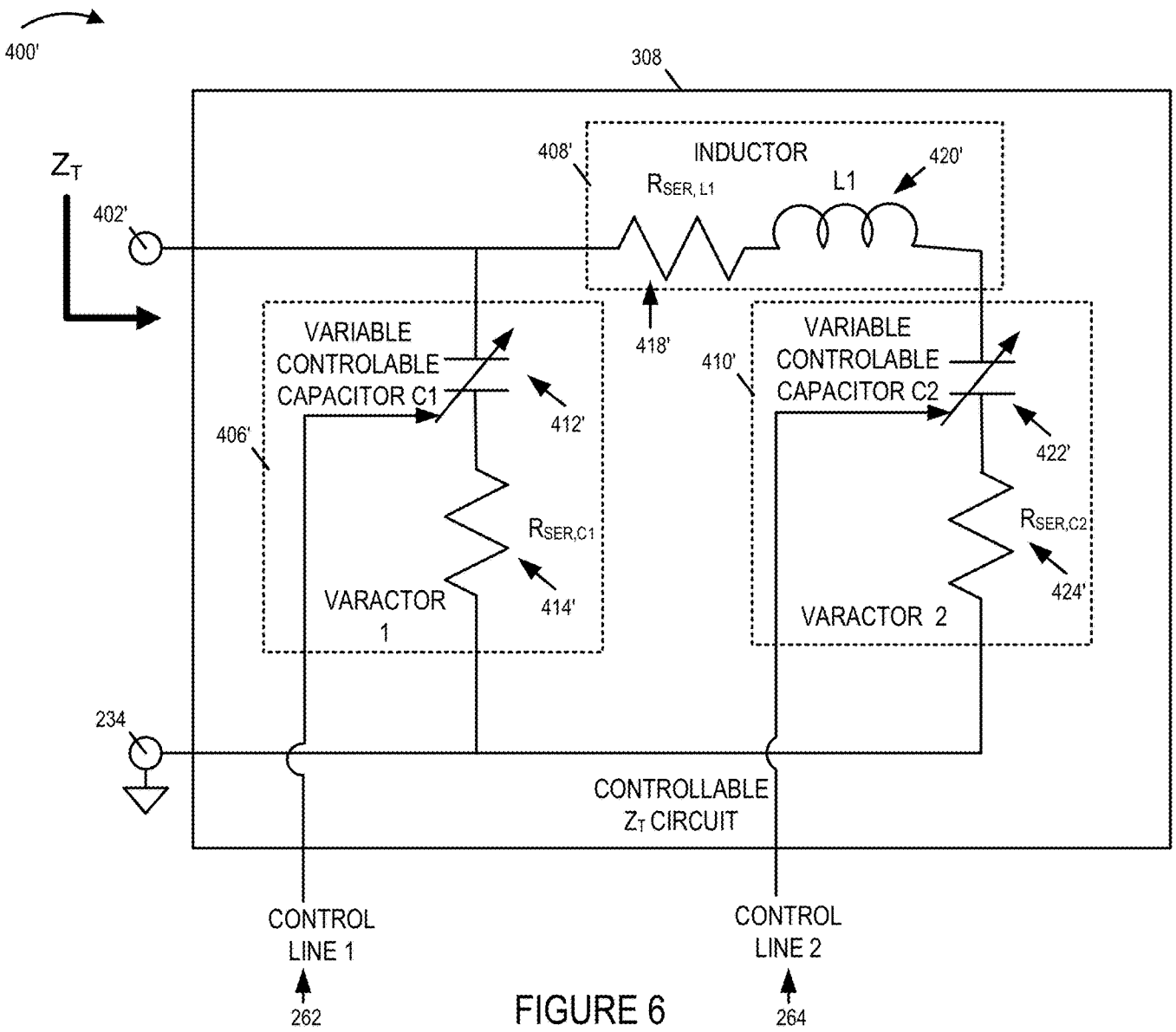
FIG. 6 is a drawing illustrating another exemplary controllable reflective load circuit, which may be included as part of a controllable reflection type phase shifter, in which each variable controllable capacitor of the another controllable reflective load is controlled by a different control line signal in accordance with an exemplary embodiment.

FIG. 6 is a drawing 400' illustrating controllable reflective load circuit 308 in accordance with an exemplary embodiment. The input impedance of controllable reflective load circuit 308, across input terminal 402' and gnd terminal 234, is ZT.

Controllable reflective load circuit 308 includes an inductor 408' and two varactors (varactor 1 406', varactor 2 410') coupled together as shown. Inductor 408' is represented as ideal inductor L1 420' and resistor (RSER,L1) 418'. Varactor 1 406' is represented as variable control capacitor C1 412' in series with resistor (RSER,C1) 414'. Varactor 2 410' is represented as variable control capacitor C2 422' in series with resistor (RSER,C2) 424'. Controllable reflective load circuit 306' includes control line 1 258' which is coupled to varactor 1 406'. Control line 1 262 receives, a control signal, e.g., a voltage signal, used to configured the value of capacitor C1 412'. Controllable reflective load circuit 308 further includes control line 2 264 which is coupled to varactor 2 410'. Control line 2 264 receives, a control signal, e.g., a voltage signal, used to configured the value of capacitor C2 422'. The values of capacitors C1 412' and C2 410' are controlled to achieve an overall desired impedance value of ZT for the reflective load circuit 308.

Figure 7:
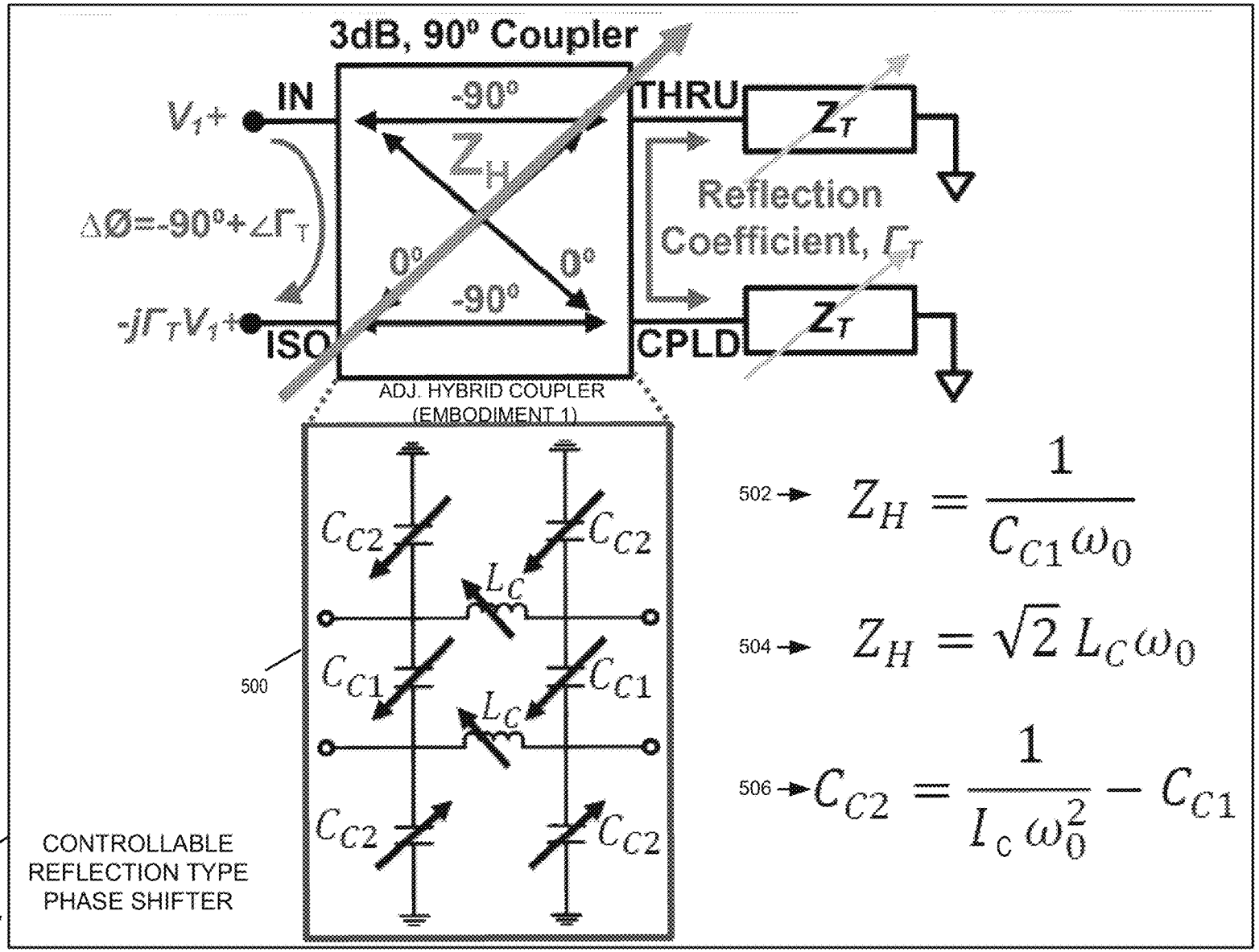
FIG. 7 is a drawing of an exemplary controllable reflection type phase shifter including an exemplary adjustable hybrid coupler including six controllable capacitors and two controllable inductors in accordance with an exemplary embodiment.

FIG. 7 is a drawing of an exemplary controllable reflection type phase shifter 224' in which the adjustable hybrid coupler 500 (in accordance with a first exemplary embodiment) includes controllable capacitors (four C2, two C1) and controllable inductors (two LC) coupled together as shown. Adjustable hybrid coupler 500 is, e.g., a first exemplary embodiment of the adjustable hybrid coupler 302 of FIG. 3. The adjustable hybrid coupler 500 has impedance ZH. The following equations are used to represent the coupler: $ZH=1/(CC1\omega 0)$, $ZH=\sqrt{2}\ LC\ \omega 0$, and $CC2=(1/LC\ \omega 02)-CC1$ are also shown in FIG. 7.

A desired value of phase shift ($\Delta\varphi$) for the controllable reflective type phase shifter can be satisfied by selected values of ZH and ZL which satisfy the equation (225) of FIG. 4: $\Delta\varphi=\text{angle}\ ((ZT-ZH)/(ZT+ZH))-90°$. When ZH is known (has been selected) and the frequency $\omega 0$ is known, the values of CC1, LC and CC2 can be determined from the equations: $ZH=1/(CC1\omega 0)$, $ZH=\sqrt{2}\ LC\ \omega 0$, and $CC2=(1/LC\ \omega 02)-CC1$.

In various embodiments, the impedance ZH of the adjustably hybrid coupler 500 is a function of the inductor and capacitor values in the coupler.

Figure 8:
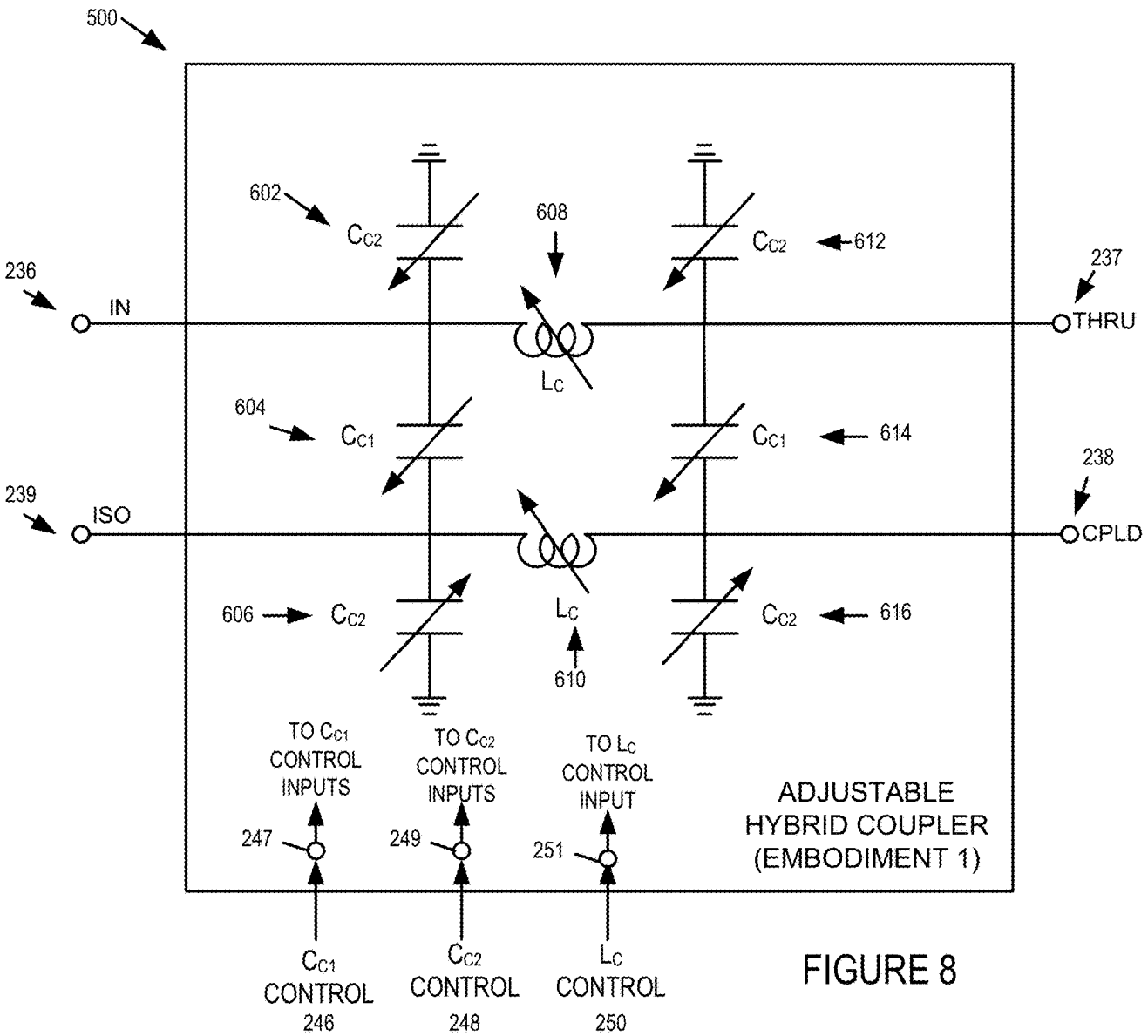
FIG. 8 is a drawing illustrating the exemplary adjustable hybrid coupler shown in FIG. 7 in more detail which further illustrates exemplary control lines, control input terminals, and coupler connection terminals.

FIG. 8 is a drawing illustrating the exemplary adjustable hybrid coupler 500 shown in FIG. 7 in more detail which further illustrates exemplary control lines, control input terminals, and coupler connection terminals, in accordance with an exemplary embodiment. Adjustable hybrid coupler 500 includes capacitor CC2 602, capacitor CC1 601, capacitor CC2 606, capacitor CC3 612, capacitor CC1 614, capacitor CC2 616, inductor LC 608, inductor LC 610, IN terminal 236, THRU terminal 237, CPLD terminal 238, and ISO terminal 239, coupled together as shown. Adjustable hybrid coupler 500 further includes CC1 control terminal 247, which receives a CC1 control signal 246, from a controller, e.g. controller 108, said control signal 246 is sent to the CC1 capacitors 604, 614, to set the CC1 capacitors at a desired value. Adjustable hybrid coupler 500 further includes CC2 control terminal 249, which receives a CC2 control signal 248, from a controller, e.g. controller 108, said control signal 248 is sent to the CC2 capacitors 602, 606, 612, 616, to set the CCs capacitors at a desired value. While the control signals supplied by controls 246, 248 and 250 are shown going to multiple elements it should be appreciated that each of the capacitors and/or inductors shown in FIG. 8 can be and sometimes are separately controlled, e.g., via a separate control line. In some such embodiments there are more than the 3 control lines shown in FIG. 8. Adjustable hybrid coupler 500 further includes LC control terminal 251, which receives a LC control signal 250, from a controller, e.g. controller 108, said control signal 250 is sent to the LC inductors 608, 610, to set the LC inductors at a desired value.

Figure 9:
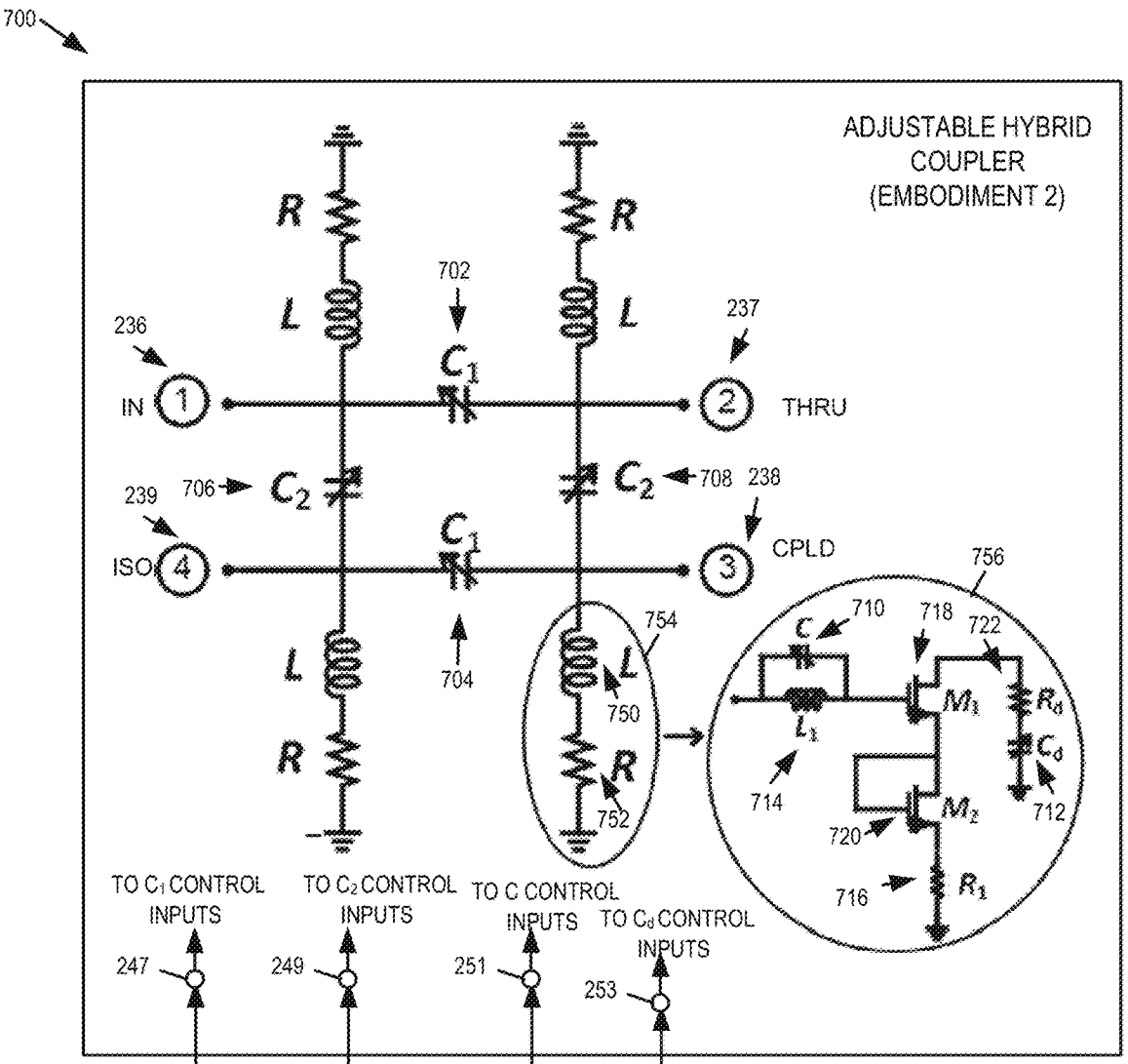
FIG. 9 is a drawing illustrating an exemplary adjustable hybrid coupler, including controllable capacitors, which may be used in an exemplary controllable reflection type phase shifter in accordance with and exemplary embodiment.

FIG. 9 is a drawing illustrating an exemplary adjustable hybrid coupler 700 in accordance with an exemplary embodiment. Adjustable hybrid coupler 700 is, e.g., a second exemplary embodiment of the adjustable hybrid coupler 302 of FIG. 3. Adjustable hybrid coupler 700 includes adjustable capacitor C1 702, adjustable capacitor C1 704, adjustable capacitor C2 706, capacitor C2 708, four equivalent inductors L, four equivalent resistors R, IN terminal 236, THRU terminal 237, CPLD terminal 238, and ISO terminal 239, coupled together as shown. Each pair 750 of an equivalent resistor R 752 in series with an equivalent inductor L 754, is in some embodiments, implemented by circuitry 756 including variable capacitor C 710, inductor L1 714, FET M1 718, FET M2 720, resistor Rd 722, resistor R1 716, and variable capacitor Cd 712. Adjustable hybrid coupler 700 further includes CC1 control terminal 247, which receives a CC1 control signal 246, from a controller, e.g. controller 108, said control signal 246 is sent to the CC1 capacitors 702, 704, to set the CC1 capacitors at a desired value. Adjustable hybrid coupler 700 further includes CC2 control terminal 249, which receives a CC2 control signal 248, from a controller, e.g. controller 108, said control signal 248 is sent to the CC2 capacitors 706, 708 to set the CCs capacitors at a desired value. Adjustable hybrid coupler 700 further includes CC control terminal 251, which receives a CC control signal 250, from a controller, e.g. controller 108, said control signal 250 is sent to the four C capacitors 710, at a desired value. Adjustable hybrid coupler 700 further includes CC control terminal 252, which receives a Cd control signal 253, from a controller, e.g. controller 108, said control signal 253 is sent to the four Cd capacitors 712, at a desired value.

In some embodiments, the adjustable hybrid coupler 700 is used for tuning the operation frequency.

In various embodiments, the impedance ZH of the adjustable hybrid coupler 700 is a function of the inductor and capacitors in the coupler.

Figure 10:
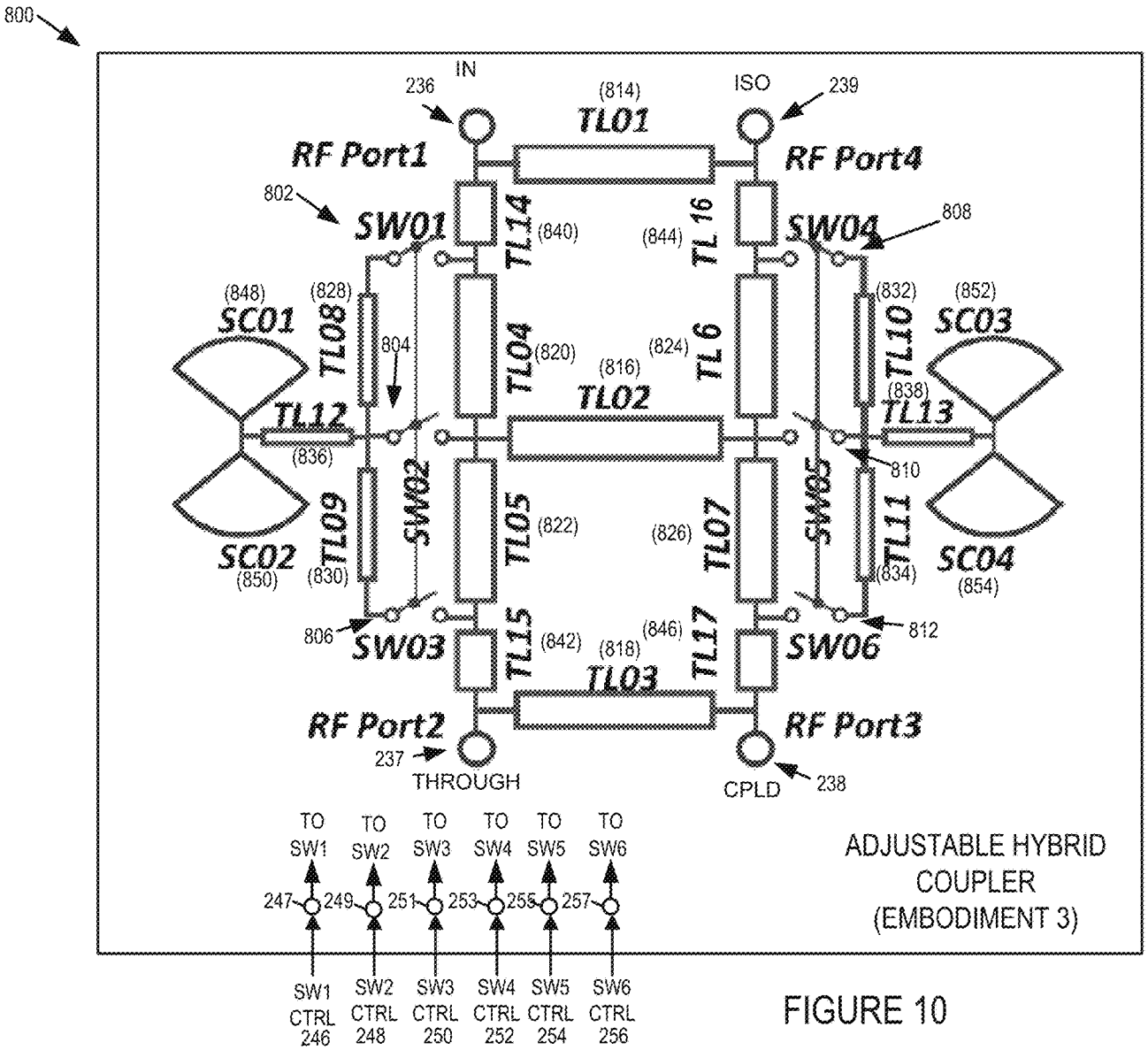
FIG. 10 is a drawing illustrating an exemplary adjustable hybrid coupler, including controllable switches and transmission lines, which may be used in an exemplary controllable reflection type phase shifter in accordance with and exemplary embodiment.

FIG. 10 is a drawing illustrating an exemplary adjustable hybrid coupler 800 in accordance with an exemplary embodiment. Adjustable hybrid coupler 800 includes IN terminal 236, ISO terminal 239, THRU terminal 237 and CPLD terminal 238. Adjustable hybrid coupler 800 is, e.g., a third exemplary embodiment of the adjustable hybrid coupler 302 of FIG. 3. Adjustable hybrid coupler 800 includes IN terminal 236 (RF Port 1), ISO terminal 239 (RF Port 4), THRU terminal 237 (RF Port 2) and CPLD terminal 238 (RF Port 3), and a plurality of transmission lines (TL01 814, TL02 816, TL03 818, TL04 820, TL05 822, TL6 824, TL07 826, TL08 828, TL09 830, TL10 832, TL11 834, TL12 836, TL13 838, TL14 840, TL15 842, TL 16 844, TL17 846), and four antennas or termination devices, e.g. short circuited stub terminations devices, (SC01 848, SC02 850, SC03 852, SC04 854). Adjustable hybrid coupler 800 further includes a plurality of controllable switches (SW 1 802, SW 2 804, SW 3 806, SW 4 808, SW 5 810, SW 6 810), as shown, used for switching various transmission lines included in the coupler 800 in or out.

Adjustable hybrid coupler 800 further includes SW1 control terminal 247, which receives a SW1 control signal 246, from a controller, e.g. controller 108, said control signal 246 is sent to the SW1 802 to control the setting of SW1. Adjustable hybrid coupler 800 further includes SW2 control terminal 249, which receives a SW2 control signal 248, from a controller, e.g. controller 108, said control signal 248 is sent to the SW2 804 to control the setting of SW1. Adjustable hybrid coupler 800 further includes SW3 control terminal 251, which receives a SW3 control signal 250, from a controller, e.g. controller 108, said control signal 250 is sent to the SW3 806 to control the setting of SW3. Adjustable hybrid coupler 800 further includes SW4 control terminal 253, which receives a SW1 control signal 252, from a controller, e.g. controller 108, said control signal 252 is sent to the SW4 808 to control the setting of SW4. Adjustable hybrid coupler 800 further includes SW5 control terminal 255, which receives a SW5 control signal 254, from a controller, e.g. controller 108, said control signal 254 is sent to the SW5 810 to control the setting of SW1. Adjustable hybrid coupler 800 further includes SW6 control terminal 257, which receives a SW6 control signal 256, from a controller, e.g. controller 108, said control signal 256 is sent to the SW5 812 to control the setting of SW6.

In various embodiments, the switches (802, 804, 806, 808, 810, 812) are set, via the control signals (246, 248, 250, 252, 254, 256), to configured the hybrid coupler 800 to have a desired value for its impedance ZH, by having a particular set of the transmission lines switched in to be used in the coupler 800.

In some embodiments, the adjustable hybrid coupler 800 is used for adjusting phase between the through and isolation ports.

In various embodiments, the transmission line can be switched to achieve desired phase shift in the transmission line based implementation of the hybrid coupler.

Figure 11A:
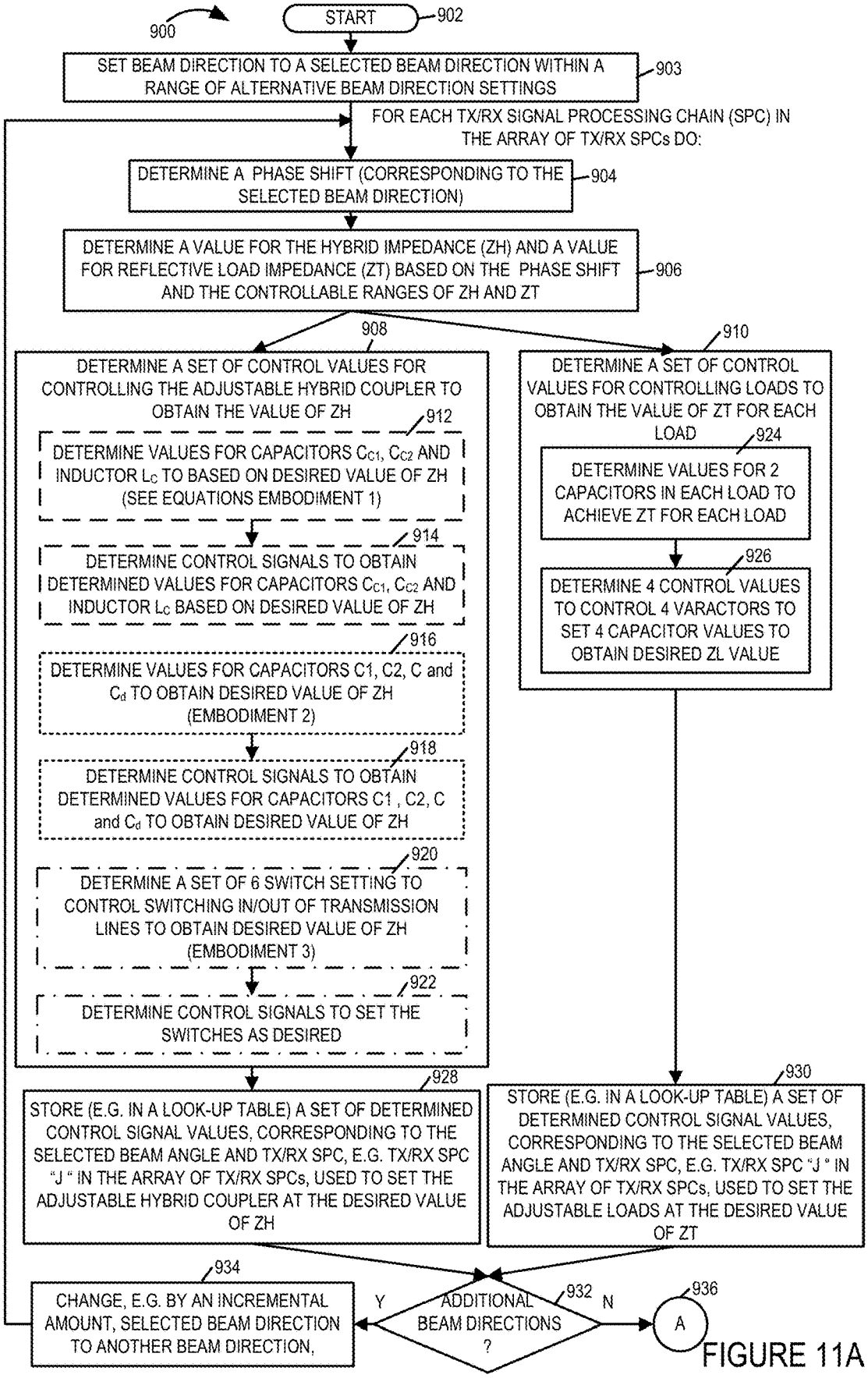
FIG. 11A is a first part of a flowchart of an exemplary method, in accordance with an exemplary embodiment, said exemplary method including: determining control value information to be used to configure controllable reflection type phase shifters, configuring, for a beam angle to be used, controllable reflection type phase shifters, included as part of a communication system including multiple signal processing chains, and operating the configured multiple signal processing chains to transmit or receive.
Figure 11B:
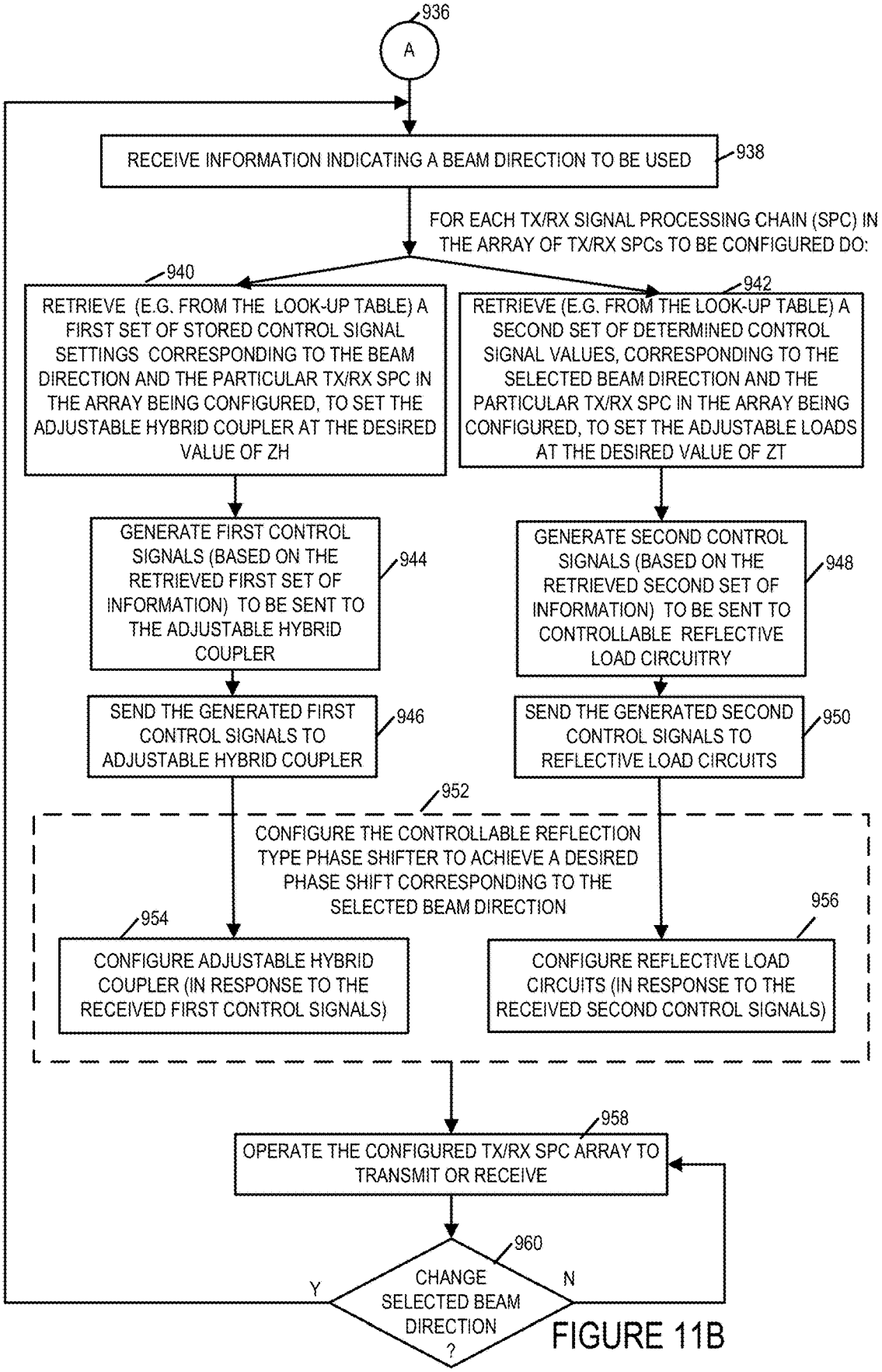
FIG. 11B is a second part of a flowchart of an exemplary method, in accordance with an exemplary embodiment, said exemplary method including: determining control value information to be used to configure controllable reflection type phase shifters, configuring, for a beam angle to be used, controllable reflection type phase shifters, included as part of a communication system including multiple signal processing chains, and operating the configured multiple signal processing chains to transmit or receive.

FIG. 11, comprising the combination of FIG. 11A and FIG. 11B is flowchart of an exemplary method, in accordance with an exemplary embodiment which may be and sometimes is implemented by the system shown in FIG. 1 in accordance with the invention. In some embodiments the steps of the exemplary method shown in FIG. 11 are implemented under control of the controller 108 with computations being performed by a processor included in the controller 108. In some embodiments in which the SPCs each include a controller 108 the controllers in individual SPCs work together with to control the components of the system to implement the method with the processor in one of the controllers determining the values discussed in the method which are then stored in memory 110 in some embodiments. The exemplary method in some embodiments includes determining control value information to be used to configure controllable reflection type phase shifters, configuring, for a beam angle to be used, controllable reflection type phase shifters included as part of a transmission system including multiple signal processing chains, and operating the configured multiple signal processing chains to transmit or receive. Operation of the exemplary method starts in step 900 and proceeds to step 903.

In step 903 the beam direction is set to a selected beam direction within a range of alternative beam direction settings. In some embodiments, there is a fixed predetermined angle between two successive beam directions with the range of alternative beam directions settings. Operation proceeds from step 903 to step 904. One iteration of steps 904, 906, 908, 910, 928 and 930 is performed for each TX/RX signal processing chain (SPC) in the array of TX/RX SPCs. For example, n iterations of steps 904, 906, 908, 910, 928 and 930 are performed, each of the n iterations corresponding to a different SPC in the array 114 of n SPCs.

In step 904, a phase shift corresponding to the selected beam direction and SPC is determined. Operation proceeds from step 904 to step 906. In step 906 a value for the hybrid impedance ZH (of the controllable adjustable hybrid coupler of the controllable reflection type phase shifter of the SPC) and a value for the reflective loads (ZT) (of the reflective load circuitry of the controllable reflection type phase shifter of the SPC) are determined based on the desired phase shift and the controllable ranges of ZH and ZT. The controllable range of ZH is a function of the particular adjustable hybrid coupler being used including the values of the components within the adjustable hybrid coupler and the range of control. The controllable range of ZL is a function of the particular adjustable reflective load circuit being used including the values of the components within the adjustable reflective load circuit and the range of control. In various embodiments, equation 225 of FIG. 4 is used in step 906 in determining values of ZH and ZL, which can be used and can be implemented, given particular implemented adjustable hybrid coupler and the particular implemented adjustable reflective load, to achieve the desired phase shift. Operation proceeds from steps 906 to steps 908 in step 910.

In step 908 a set of control values for controlling the adjustable hybrid coupled to obtain the determined value of ZH are determined.

In some embodiments, e.g. an embodiment in which the adjustable hybrid coupler is adjustable hybrid coupler 500 of FIGS. 7 and 8, step 908 includes step 912 and 914. In step 912 values are determined for: controllable capacitors CC1, CC2 and controllable inductor LC based on the determined value of adjustable hybrid coupler impedance ZH. For example the equations (502, 504, 506) shown in FIG. 7 are used. The value for CC1 is determined from equation 502, with ZH and the frequency ω0 being known. The value for LC is determined from equation 504, with ZH and the frequency ω0 being known. Then the value for CC1 is determined from equation 506, with the value of LC, the value of CC1 and the frequency ω0 being known. Operation proceeds from step 912 to step 914, in which control signals are determined to obtain the values for capacitors CC1, CC2 and inductor Lc based on the desired value of ZH. For example, control signal values, e.g. control voltage level values, are determined, based on the characteristic (specification) of the implemented control circuits to achieve the determined values of step 912 for capacitors CC1, CC2 and inductor Lc.

In some embodiments, e.g. an embodiment in which the adjustable hybrid coupler is adjustable hybrid coupler 700 of FIG. 9, step 910 includes step 916 and 918. In step 916 values are determined for: controllable capacitors C1, C2, C, and Cd based on the determined value of adjustable hybrid coupler impedance ZH. Operation proceeds from step 916 to step 918, in which control signals are determined to obtain the values for capacitors C1, C2, C, and Cd based on the desired value of ZH. For example, control signal values, e.g. control voltage level values, are determined, based on the characteristic (specification) of the implemented control circuits to achieve the determined values of step 916 for capacitors C1, C2, C, and Cd.

In some embodiments, e.g. an embodiment in which the adjustable hybrid coupler is adjustable hybrid coupler 800 of FIG. 10, step 910 includes step 920 and 922. In step 920, a set of six (6) switch setting are determined to control switching in/out of transmission liens to obtain the desired determined value for ZH. Operation proceeds from step 920 to step 922, in which control signals are determined to set the switches as desired (setting of step 920), e.g. a logic one (or particular predetermined first voltage level) control signal may indicate that a switch should be closed and a logic 0 (or particular predetermined second voltage level) control signal may indicate that the switch should be open.

Operation proceeds from step 908 to step 928. In step 928 the determined set of control signal values (e.g., from one of step 914, 918 or 922, depending upon the particular embodiment of the hybrid coupler being used), corresponding to the selected beam angle and the particular SPC for which control data is now being determined, e.g. exemplary TX/RX SPC "j" in the array 114 of n SPCs, is stored, e.g., in a look-up table, which is included in or accessible by controller 108, said stored set of control signal values to be used to set the adjustable hybrid coupler at the desired value of ZH when the selected beam angle is to be used.

Returning to step 910, in step 910 a set of control values for controlling reflective loads to obtain the determined value of ZT (from step 906) for each reflective load are determined. Step 910 includes step 924 and step 926. In step 924 values for 2 capacitors in each load ((C1 412, C2 422) in reflective load 306 of FIGS. 3 and 5) and ((C1 412', C2 422') in reflective load 308 of FIGS. 3 and 6) and are determined to achieve ZT for each reflective load. Operation proceeds from step 924 to step 926. In step 926, four (4) control signals are determined to control the 4 varactors (406, 410, 406' 410') to set the four capacitor values to obtain the determined value of ZT, e.g., control signal voltages are determined to control the four varactors to set their capacitors at the desired values from step 924.

Operation proceeds from step 910 to step 930. In step 930 the determined set of control signal values (from step 926), corresponding to the selected beam angle and the particular SPC for which control data is now being determined, e.g. exemplary TX/RX SPC "j" in the array 114 of n SPCs, is stored, e.g., in a look-up table, which is included in or accessible by controller 108, said stored set of control signal values to be used to set the adjustable reflective loads at the desired value of ZL when the selected beam angle is to be used.

After the multiple iterations of steps 904, 906, 908, 910, 928 and 930 have been performed, one iteration for each TX/RX signal processing chain (SPC) in the array of TX/RX SPCs, operation proceeds from step 928 and 930 to step 932.

In step 932 a check is made as to whether or not there are additional beam directions for which configuration information is to be determined. If the determination of step 932 is that there are additional beam directions, then operation proceeds from step 932 to step 934, in which the selected beam direction is changed, e.g., by an incremental amount, e.g. one step, to another beam direction. Operation proceeds from step 934 to the input of step 904 in which a phase shift (corresponding to the another selected beam direction is determined, e.g., for a first TX signal processing chain. Operation continues as previous described to obtain configuration information for each of the SPCs corresponding to the new beam direction.

Retuning to step 932, if the determination, is that there are not any additional beam directions for which configuration information is to be determined, then operation proceeds from step 932, via connecting node A 936, to step 938.

In step 938 a controller, e.g., controller 108, receives information indicating a beam direction to be used. Operation proceeds from step 938 to step 940 and 942. Steps 940, 942, 944, 936, 948, 952 including steps 954 and 956, are performed for each TX/RX signal processing chain (SPC) in the array of SPCs to be configured. For example, n iterations of steps 940, 942, 944, 936, 948, 952 including steps 954 and 956, are performed, each of the n iterations corresponding to a different SPC in the array 114 of n SPCs.

In step 940 the controller retrieves, e.g., from the look-up table, a first set of stored control signal setting corresponding to the beam direction and the particular RX/RX SPC in the array being configured, to set the adjustable hybrid coupler at the desired value of ZH. Operation proceeds from step 940 to step 944. In step 944 the controller generates first control signals (based on the retrieved first set of information) to be sent to the adjustable hybrid coupler. Operation proceeds from step 944 to step 946. In step 946 the controller sends the generated first control signals to the adjustable hybrid coupler. Operation proceeds from step 946 to step 954. In step 954 the adjustable hybrid coupler receives the generated first control signals and configures the adjustable hybrid coupler in accordance with the received first control signals, e.g. setting the adjustable hybrid coupler to have the currently desired value of ZH.

Retuning to step 942, in step 942 the controller retrieves, e.g., from the look-up table, a second set of stored control signal setting corresponding to the beam direction and the particular RX/RX SPC in the array being configured, to set the adjustable (reflective) loads at the desired value of ZL. Operation proceeds from step 942 to step 948. In step 948 the controller generates second control signals (based on the retrieved second set of information) to be sent to the reflective load circuits. Operation proceeds from step 948 to step 950. In step 950 the controller sends the generated second control signals to the reflective load circuits. Operation proceeds from step 950 to step 956. In step 956 the reflective load circuits receive the generated second control signals and configure the adjustable reflective loads in accordance with the received second control signals, e.g. setting each of the adjustable reflective loads to have the currently desired value of ZT.

Step 954 and step 956 are part of step 952 in which the controllable reflection type phase shifter of an SPC is configured to achieve a desired phase shift corresponding to the selected beam direction.

After the multiple iterations of steps 940, 942, 944, 936, 948, 952 including steps 954 and 956, have been performed, one iteration for each TX/RX signal processing chain (SPC) in the array of TX/RX SPCs, operation proceeds from step 952 and to step 958.

In step 958 the configured TX/RX SPC array is operated to transmit or receive. Operation proceeds from step 958 to step 960. In step 960, a check is performed as to whether or not the beam direction is to be changed. If the determination is that the beam direction is not be changed, the n operation proceeds from step 960 to step 958, in which the array continues to operate to transmit or receive using the current beam direction. However, if the determination of step 960 is that the beam direction is to changed, then operation proceeds from step 960 to the input of step 938, in which the controller receives information indicating a new beam direction to be used. Operation proceeds from step 938 to step 940 and 942, and continues in a similar manner as previously described and control information for configuration is retrieved corresponding to the new beam direction.

Following are various sets of exemplary numbered method and apparatus embodiments which are intended to be exemplary. In each set of numbered exemplary embodiments a reference to a preceding embodiment refers to an embodiment in the same exemplary set as the embodiment which includes the reference to the preceding numbered embodiment.

Exemplary Numbered Apparatus Embodiments

Apparatus Embodiment 1

A communications system (100), comprising: a first controller (108) for generating an impedance control signal (244) and multiple phase shift control signals (246, 248, 250, 252, 254, 256, 258, 260, 262, 264); a first signal processing chain (116) (e.g., a first transmit/receive signal processing chain) including: a first controllable impedance (222) having a first impedance control input (245) coupled to said controller (108); a first controllable reflection type phase shifter (224) coupled to the first controllable impedance (222) and having one more phase shift control inputs (247, 249, 251, 253, 255, 257, 259, 261, 263, 265) coupled to said controller (108) for receiving multiple phase shift control values (e.g., capacitance control values, inductance control values or switch setting control values) from said controller (108); a first amplifier circuit (227) coupled to the first controllable reflection type phase shifter (224); and a first antenna element (210) coupled to the first amplifier circuit (227).

Apparatus Embodiment 1A

The communication system (100) of Apparatus Embodiment 1 wherein said first controller (108) is part of said first signal processing chain (118) (see FIG. 2) or is external to said first signal processing chain (118) (See FIG. 2).

Apparatus Embodiment 2

The communication system (100) of Apparatus Embodiment 1, wherein said first controllable type phase shifter (244) includes an adjustable hybrid coupler (302 or 500 or 600 or 700) and reflective load circuitry (304).

Apparatus Embodiment 2A

The communication system (100) of Apparatus Embodiment 2, the reflective load circuitry (304) is adjustable.

Apparatus Embodiment 3

The communication system (100) of Apparatus Embodiment 2, wherein said first controller (108) is configured to generate multiple separate capacitance control signals (258, 260, 262, 264) to control separate variable capacitance elements (406, 410, 406' 410') (and/or inductor elements) of the reflective load circuitry (304) of the first controllable reflection type phase shifter (224).

Apparatus Embodiment 3A

The communication system (100) of Apparatus Embodiment 3, wherein said variable capacitance elements (406, 410, 406', 410') are varactors, capacitor banks and/or a combination of both.

Apparatus Embodiment 4

The communication system (100) of Apparatus Embodiment 2, wherein said adjustable hybrid coupler (302 or 500) includes adjustable capacitors (C2 602, C1 604, C2 606, C2 612, C1 614, C2 616) and adjustable inductors (LC608, LC610).

Apparatus Embodiment 4A

The communication system (100) of Apparatus Embodiment 2, wherein said first controller (108) is configured to generate multiple separate control signals (246, 248, 250) to control different subsets of elements ((subset of C1 caps 604, 614), (subset of C2 caps 602, 606, 612, 616), (subset of LC608, LC610)) of the adjustable hybrid coupler (302 or 500) of the first controllable reflection type phase shifter (224).

Apparatus Embodiment 5

The communication system (100) of Apparatus Embodiment 2, wherein said adjustable hybrid coupler (302 or 700) includes adjustable capacitors (C1 702, C1 704, C2 706, C2 708, C 710, Cd 712),

Apparatus Embodiment 5A

The communication system (100) of Apparatus Embodiment 2, wherein said first controller (108) is configured to generate multiple separate control signals (246, 248, 250, 252) to control different subsets of capacitors ((subset of C1 caps 702, 704), (subset of C2 caps 706, 708), (subset of four C 710 caps), (subset of 4 Cd 712 caps)) of the adjustable hybrid coupler (302 or 500) of the first controllable reflection type phase shifter (224).

Apparatus Embodiment 5B

The communication system (100) of Apparatus Embodiment 5, wherein said adjustable hybrid coupler (302 or 700) further includes inductors (L1 714), resistors (R1 716) and field effect transistors (M1 718, M2 720).

Apparatus Embodiment 6

The communication system (100) of Apparatus Embodiment 2, wherein said adjustable hybrid coupler (302 or 800) includes controllable switches (SW 802, SW 2 804, SW3 806, SW4 808, SW 5 810, SW 6 812), for including or omitting transmission lines, inductors or capacitors.

Apparatus Embodiment 6A

The communication system (100) of Apparatus Embodiment 2, wherein said first controller (108) is configured to generate control signals (246, 248, 250, 252, 254, 256) to set the controllable switches (SW 802, SW 2 804, SW3 806, SW4 808, SW 5 810, SW 6 812) to a desired position corresponding to a selected antenna array pattern.

Apparatus Embodiment 6AA

The communication system (100) of Apparatus Embodiment 6A, wherein said controller generates the control signals based on values in a stored table (e.g., stored control signal mapping information) which stores control signal values to be used for a phase shift which is to be used for communication of signals from the communication system.

Apparatus Embodiment 6B

The communication system (100) of Apparatus Embodiment 6, wherein said first controller (108) is configured to switch transmission line elements in said hybrid coupler to change the phase shift of the adjustable hybrid coupler.

Apparatus Embodiment 7

The communication system (100) of Apparatus Embodiment 1, further comprising one or more additional processing chains (118, 120, . . . , 130), said first processing chain (116) and said one or more additional processing chains (118, 120, . . . , 130) being part of an array 114 of signal processing chains.

Apparatus Embodiment 8

The communication system (100) of Apparatus Embodiment 7, further comprising: a memory 110 coupled to said first controller (108), said memory including control signal mapping information (112).

Apparatus Embodiment 8A

The communication system (100) of Apparatus Embodiment 1, wherein said control signal mapping information (112) is a look-up table which includes, for each of a plurality of selectable beam directions, a plurality of sets of control signal values, (e.g. sets of pre-computed control signal values, each set corresponding to a different array patterns where different array patterns may and sometimes do correspond to different beam directions) each set of control signal values for configuring a controllable reflection type phase shifter (224) in a different signal processing chain (116, 118, 120, 122, 124, 126, 128, . . . , 130) in an array (114) of signal processing chains.

Apparatus Embodiment 9

The communication system (100) of Apparatus Embodiment 2, wherein said first controllable type phase shifter (244) induces a desired phase shift between an input terminal (IN 236) and output terminal (ISO 239).

Apparatus Embodiment 9A

The communication system (100) of Apparatus Embodiment 9, wherein said desired phase shift is a function of the beam direction.

Apparatus Embodiment 9B

The communication system (100) of Apparatus Embodiment 9, wherein said induced desired phase shift is a function of a configured impedance (ZH) of the adjustable hybrid coupler (302) (based on control signals 246, 248, 250, 251, 252, 254, 256) and a configured impedance (ZT) of a reflective load in the reflective load circuitry (304) (based on control signals 258, 260, 262, 264). (Phase shift=Angle (ZT−ZH)/(ZT+ZH)−90 degrees).

In various exemplary method embodiments implemented by the system 100 under control of the controller 108 (or controllers in the case where SPCs each included a controller 108) are possible. In some embodiments the controller 108 includes a processor and memory with the controller controlling the components in the system 100 to implement the steps of the method embodiments. The processor in the controller 108 in some embodiments performs one or more determining steps with the controller then storing the determined control values in memory 110 as part of one or more storing steps. In some embodiments the exemplary method includes building a look-up table (e.g., to be used during operation such as transmission or reception of data) for configuring the adjustable hybrid couplers and/or loads of multiple RX/TX signal processing chains (SPCs) in the array of SPCs to achieve desired phase shift angles corresponding to a plurality of different beam directions. In some but not necessarily all embodiments adjusting a hybrid coupler and the reflective impedances equalizes the gain across phase shift settings.

First and second sets of numbered method embodiments, which can and sometimes are implemented by the system 100, incorporating or implemented using one or more components shown in the other figures, will now be discussed.

First Set of Exemplary Numbered Method Embodiments

1. A method, the method comprising:

determining (904), for a first processing chain, a first phase shift corresponding to a first selected beam direction; determining (906), for the first processing chain, a first value for a hybrid impedance (ZH) of a adjustable hybrid coupler and a first value for a reflective load impedance (ZT) of a reflective load based on the first phase shift and controllable ranges of ZH and ZT; determining (908), for the first processing chain, a first set of control values for controlling the adjustable hybrid coupler of the first processing chain to be set at the determined first value of ZH; determining (910), for the first processing chain, a first set of control values for controlling loads in reflective load circuitry of the first processing chain to be set at the determined first value of ZT; storing (e.g., in a look-up table) said determined first set of control values for controlling the adjustable hybrid coupler in the first processing chain to be set at the first determined value of ZH; and storing (e.g., in the look-up table) and said determined first set of control values for controlling loads in reflective load circuitry in the first processing chain to be set at the first determined value of ZT.

1A. The method of method 1A wherein the method is implemented by the system (100) operating under the control of the controller 108 in the signal processing chains (SPCs) which causes the components in the system (100) to implement the steps of the method with in some embodiments one of the controllers 108 performing the determining steps and then storing the results in memory (110) or memory within one or more SPC (116, 118, etc.) of the set of SPCs.

2. The method of method 1, further comprising:

determining (904), for a second processing chain, a second phase shift corresponding to the first selected beam direction; determining (906), for the second processing chain, a second value for a hybrid impedance (ZH) of a adjustable hybrid coupler and a second value for a reflective load impedance (ZT) of a reflective load based on the second phase shift and controllable ranges of ZH and ZT; determining (908), for the second processing chain, a second set of control values for controlling the adjustable hybrid coupler of the second processing chain to be set at the determined second value of ZH; determining (910), for the second processing chain, a second set of control values for controlling loads in reflective load circuitry of the second processing chain to be set at the determined second value of ZT; storing (e.g., in a look-up table) said determined second set of control values for controlling the adjustable hybrid coupler in the second processing chain to be set at the determined second value of ZH; and storing (e.g., in the look-up table) and said determined second set of control values for controlling loads in reflective load circuitry in the second processing chain to be set at the determined second value of ZT.

3. The method of method 2, further comprising:

determining (904), for the first processing chain, a third phase shift corresponding to a second selected beam direction; determining (906), for the first processing chain, a third value for a hybrid impedance (ZH) of a adjustable hybrid coupler and a third value for a reflective load impedance (ZT) of a reflective load based on the third phase shift and controllable ranges of ZH and ZT; determining (908), for the first processing chain, a third set of control values for controlling the adjustable hybrid coupler of the first processing chain to be set at the determined third value of ZH; determining (910), for the first processing chain, a third set of control values for controlling loads in reflective load circuitry of the first processing chain to be set at the third determined value of ZT; storing (e.g., in a look-up table) said determined third set of control values for controlling the adjustable hybrid coupler in the first processing chain to be set at the third determined value of ZH; and storing (e.g., in the look-up table) and said determined third set of control values for controlling loads in reflective load circuitry in the first processing chain to be set at the determined third value of ZT.

4. The method of method 1, further comprising:

determining (904), for the second processing chain, a fourth phase shift corresponding to the second selected beam direction; determining (906), for the second processing chain, a fourth value for a hybrid impedance (ZH) of a adjustable hybrid coupler and a fourth value for a reflective load impedance (ZT) of a reflective load based on the fourth phase shift and controllable ranges of ZH and ZT; determining (908), for the second processing chain, a fourth set of control values for controlling the adjustable hybrid coupler of the second processing chain to be set at the fourth determined value of ZH; determining (910), for the second processing chain, a fourth set of control values for controlling loads in reflective load circuitry of the second processing chain to be set at the fourth determined value of ZT; storing (e.g., in a look-up table) said determined fourth set of control values for controlling the adjustable hybrid coupler in the second processing chain to be set at the determined fourth value of ZH; and storing (e.g., in the look-up table) said determined fourth set of control values for controlling loads in reflective load circuitry in the second processing chain to be set at the determined fourth value of ZT.

Second Set of Exemplary Numbered Method Embodiments

1. A method of operating a communications device, comprising: receiving (938) information indicating a beam direction to be used (e.g., a beam direction which has been selected for transmission or reception purposes); retrieving (940) a first set of stored control signal setting information corresponding to the beam direction and a first signal processing chain to set an adjustable hybrid coupler in the first signal processing chain at a first desired value of ZH; generating (944) first control signals to be sent to the adjustable hybrid coupler of the first signal processing chain; sending (946) the generated first control signals to the adjustable hybrid coupler of the first signal processing chain; configuring (954) the adjustable hybrid coupler of the first signal processing chain based on the first received control signals; and operating (958) the first signal processing chain to transmit or receive.

1A. The method of method 1, wherein the method is implemented by the system (100) operating under the control of the controller 108 (or controllers in the signal processing chains (SPCs)) which causes the components in the system (100) to implement the steps of the method. The controller 100 includes in some embodiments a processor and memory storing executable instructions which cause the processor to control the components of the system 100 to implement the steps of the method, e.g., shown in FIG. 11.

1AAA. The method of method 1A, further comprising, prior to operating the first signal processing chain to transmit or receive, performing the steps of: retrieving (942) a second set of stored control signal setting corresponding to the beam direction and the first signal processing chain to set adjustable loads in the first signal processing chain at a first desired value of ZT; generating (948) second control signals to be sent to the controllable reflective load circuitry of the first signal processing chain; sending (950) the generated second control signals to the controllable reflective load circuitry of the first signal processing chain; and configuring (956) the reflective load circuits of the first signal processing chain based on the second received control signals.

1AAA. The method of method 1AA, further comprising: retrieving (940) a third set of stored control signal setting information corresponding to the beam direction and a second signal processing chain to set an adjustable hybrid coupler in the second signal processing chain at a second desired value of ZH; generating (944) third control signals to be sent to the adjustable hybrid coupler of the second signal processing chain; sending (946) the generated third control signals to the adjustable hybrid coupler of the second signal processing chain; configuring (954) the adjustable hybrid coupler of the second signal processing chain based on the third received control signals; and operating (958) the second signal processing chain to transmit or receive.

1 AAAA. The method of method 1AAA, further comprising, prior to operating the second signal processing chain to transmit or receive, performing the steps of: retrieving (942) a fourth set of stored control signal setting information corresponding to the beam direction and the second signal processing chain to set adjustable loads in the second signal processing chain at a second desired value of ZT; generating (948) fourth control signals to be sent to the controllable reflective load circuitry of the send signal processing chain; sending (950) the generated fourth control signals to the controllable reflective load circuitry of the second signal processing chain; and configuring (956) the reflective load circuits of the second signal processing chain based on the fourth received control signals.

1 AB. The method of method 1AAAA, wherein said steps of operating (958) the first signal processing chain to transmit or receive and operating (958) the second signal processing chain to transmit or receive are performed in parallel with the first and second signal processing chains being controlled to transmit or receive at the same time.

1A. The method of method 1AAA, wherein configuring the adjustable hybrid coupler of the first processing chain and configuring the reflective load circuits of the first processing chain is performed as part of configuring a controllable reflection type phase shifter in the first processing chain for a desired phase shift corresponding to the beam direction.

2. The method of method 1, further comprising: determining (960) that beam direction is to be changed.

3. The method of method 2, further comprising: receiving (938 second iteration) information indicating a new beam direction to be used.

The techniques of various embodiments may be implemented using software, hardware and/or a combination of software and hardware. Various embodiments are directed to apparatus and/or systems, wireless communications systems, e.g., wireless communications systems supporting beamforming, a signal processing chain including a reflective type phase shifter, a controllable reflective type phase shifter, a controllable hybrid coupler, a controllable reflective load, a controller, wireless terminals, user equipment (UE) devices, access points, e.g., a WiFi wireless access point, a cellular wireless AP, e.g., an eNB or gNB, user equipment (UE) devices, a wireless cellular systems, e.g., a cellular system, WiFi networks, etc. Various embodiments are also directed to methods, e.g., method of controlling and/or operating a system or device, e.g., a communications system supporting beamforming, a signal processing chain including a reflective type phase shifter, a controllable reflective type phase shifter, a controllable hybrid coupler, a controllable reflective load, a controller, an access point, a base station, a wireless terminal, a UE device, etc. Various embodiments are also directed to machine, e.g., computer, readable medium, e.g., ROM, RAM, CDs, hard discs, etc., which include machine readable instructions for controlling a machine to implement one or more steps of a method. The computer readable medium is, e.g., non-transitory computer readable medium.

It is understood that the specific order or hierarchy of steps in the processes and methods disclosed is an example of exemplary approaches. Based upon design preferences, it is understood that the specific order or hierarchy of steps in the processes and methods may be rearranged while remaining within the scope of the present disclosure. The accompanying method claims present elements of the various steps in a sample order, and are not meant to be limited to the specific order or hierarchy presented. In some embodiments, one or more processors are used to carry out one or more steps of the each of the described methods.

In various embodiments each of the steps or elements of a method are implemented using one or more processors. In some embodiments, each of elements or steps are implemented using hardware circuitry.

In various embodiments nodes and/or elements described herein are implemented using one or more components to perform the steps corresponding to one or more methods, for example, controlling, establishing, generating a message, message reception, signal processing, sending, communicating, e.g., receiving and transmitting, comparing, making a decision, selecting, making a determination, modifying, controlling determining and/or transmission steps. Thus, in some embodiments various features are implemented using components or in some embodiments logic such as for example logic circuits. Such components may be implemented using software, hardware or a combination of software and hardware. Many of the above described methods or method steps can be implemented using machine executable instructions, such as software, included in a machine readable medium such as a memory device, e.g., RAM, floppy disk, etc. to control a machine, e.g., general purpose computer with or without additional hardware, to implement all or portions of the above described methods, e.g., in one or more nodes. Accordingly, among other things, various embodiments are directed to a machine-readable medium, e.g., a non-transitory computer readable medium, including machine executable instructions for causing a machine, e.g., processor and associated hardware, to perform one or more of the steps of the above-described method(s). Some embodiments are directed to a device, e.g., a wireless communications device including a multi-element antenna array supporting beam forming, such as a cellular AP or Wifi AP, a wireless terminal, a UE device, a signal processing chain including a reflective type phase shifter, a controllable reflective type phase shifter, a controllable hybrid coupler, a controllable reflective load, a controller, etc., including a processor configured to implement one, multiple or all of the steps of one or more methods of the invention.

In some embodiments, the processor or processors, e.g., CPUs, of one or more devices, are configured to perform the steps of the methods described as being performed by the devices, e.g., communication nodes. The configuration of the processor may be achieved by using one or more components, e.g., software components, to control processor configuration and/or by including hardware in the processor, e.g., hardware components, to perform the recited steps and/or control processor configuration. Accordingly, some but not all embodiments are directed to a device, e.g., a controllable reflective type phase shifter, a controllable hybrid coupler, a controllable reflective load, a controller, access point, with a processor which includes a component corresponding to each of the steps of the various described methods performed by the device in which the processor is included. In some but not all embodiments a device, wireless communications node such as an access point or base station, includes a component corresponding to each of the steps of the various described methods performed by the device in which the processor is included. The components may be implemented using software and/or hardware.

Some embodiments are directed to a computer program product comprising a computer-readable medium, e.g., a non-transitory computer-readable medium, comprising code for causing a computer, or multiple computers, to implement various functions, steps, acts and/or operations, e.g. one or more steps described above. Depending on the embodiment, the computer program product can, and sometimes does, include different code for each step to be performed. Thus, the computer program product may, and sometimes does, include code for each individual step of a method, e.g., a method a wireless communications device such as an access point, a controllable reflective type phase shifter, a controllable hybrid coupler, a controllable reflective load, a controller, etc. The code may be in the form of machine, e.g., computer, executable instructions stored on a computer-readable medium, e.g., a non-transitory computer-readable medium, such as a RAM (Random Access Memory), ROM (Read Only Memory) or other type of storage device including eFUSE devices or circuits. In addition to being directed to a computer program product, some embodiments are directed to a processor configured to implement one or more of the various functions, steps, acts and/or operations of one or more methods described above. Accordingly, some embodiments are directed to a processor, e.g., CPU, configured to implement some or all of the steps of the methods described herein. The processor may be for use in a wireless communications device such as an access point described in the present application.

Numerous additional variations on the methods and apparatus of the various embodiments described above will be apparent to those skilled in the art in view of the above description. Such variations are to be considered within the scope. Numerous additional embodiments, within the scope of the present invention, will be apparent to those of ordinary skill in the art in view of the above description and the claims which follow. Such variations are to be considered within the scope of the invention.

What is claimed is:

1. A communications system, comprising:

a first controller for generating an impedance control signal and multiple phase shift control signals;

a first signal processing chain including:

a first controllable impedance having a first impedance control input coupled to said first controller;

a first controllable reflection type phase shifter coupled to the first controllable impedance and having one more phase shift control inputs coupled to said first controller for receiving multiple phase shift control values from said first controller;

a first amplifier circuit coupled to the first controllable reflection type phase shifter; and a first antenna element coupled to the first amplifier circuit.

2. The communication system of claim 1, wherein said first controllable reflection type phase shifter includes an adjustable hybrid coupler and reflective load circuitry.

3. The communication system of claim 2, wherein said first controller is configured to generate multiple separate capacitance control signals to control separate variable capacitance elements of the reflective load circuitry of the first controllable reflection type phase shifter.

4. The communication system of claim 2, wherein said adjustable hybrid coupler includes adjustable capacitors and adjustable inductors.

5. The communication system of claim 2, wherein said adjustable hybrid coupler includes adjustable capacitors.

6. The communication system of claim 2, wherein said adjustable hybrid coupler includes controllable switches, for including or omitting transmission lines, inductors or capacitors.

7. The communication system of claim 2, wherein said first controllable reflection type phase shifter induces a desired phase shift between an input terminal and output terminal.

8. The communication system of claim 1, further comprising one or more additional processing chains, said first signal processing chain and said one or more additional processing chains being part of an array of signal processing chains.

9. The communication system of claim 8, further comprising:

a memory coupled to said first controller, said memory including control signal mapping information.

10. A method, the method comprising:

determining, for a first processing chain, a first phase shift corresponding to a first selected beam direction;

determining, for the first processing chain, a first value for a hybrid impedance (ZH) of a adjustable hybrid coupler and a first value for a reflective load impedance (ZT) of a reflective load based on the first phase shift and controllable ranges of ZH and ZT;

determining, for the first processing chain, a first set of control values for controlling the adjustable hybrid coupler of the first processing chain to be set at the determined first value of ZH;

determining, for the first processing chain, a first set of control values for controlling loads in reflective load circuitry of the first processing chain to be set at the determined first value of ZT;

storing said determined first set of control values for controlling the adjustable hybrid coupler in the first processing chain to be set at the first determined value of ZH; and storing said determined first set of control values for controlling loads in reflective load circuitry in the first processing chain to be set at the first determined value of ZT.

11. The method of claim 10, wherein the method is implemented by a system operating under the control of a controller.

12. The method of claim 10, further comprising:

determining, for a second processing chain, a second phase shift corresponding to the first selected beam direction;

determining, for the second processing chain, a second value for a hybrid impedance (ZH) of a adjustable hybrid coupler and a second value for a reflective load impedance (ZT) of a reflective load based on the second phase shift and controllable ranges of ZH and ZT;

determining, for the second processing chain, a second set of control values for controlling the adjustable hybrid coupler of the second processing chain to be set at the determined second value of ZH;

determining, for the second processing chain, a second set of control values for controlling loads in reflective load circuitry of the second processing chain to be set at the determined second value of ZT;

storing said determined second set of control values for controlling the adjustable hybrid coupler in the second processing chain to be set at the determined second value of ZH; and storing and said determined second set of control values for controlling loads in reflective load circuitry in the second processing chain to be set at the determined second value of ZT.

13. The method of claim 12, further comprising:

determining, for the first processing chain, a third phase shift corresponding to a second selected beam direction;

determining, for the first processing chain, a third value for a hybrid impedance (ZH) of a adjustable hybrid coupler and a third value for a reflective load impedance (ZT) of a reflective load based on the third phase shift and controllable ranges of ZH and ZT;

determining, for the first processing chain, a third set of control values for controlling the adjustable hybrid coupler of the first processing chain to be set at the determined third value of ZH;

determining, for the first processing chain, a third set of control values for controlling loads in reflective load circuitry of the first processing chain to be set at the third determined value of ZT;

storing said determined third set of control values for controlling the adjustable hybrid coupler in the first processing chain to be set at the third determined value of ZH; and storing said determined third set of control values for controlling loads in reflective load circuitry in the first processing chain to be set at the determined third value of ZT.

14. The method of claim 13, further comprising:

determining, for the second processing chain, a fourth phase shift corresponding to the second selected beam direction;

determining, for the second processing chain, a fourth value for a hybrid impedance (ZH) of a adjustable hybrid coupler and a fourth value for a reflective load impedance (ZT) of a reflective load based on the fourth phase shift and controllable ranges of ZH and ZT;

determining, for the second processing chain, a fourth set of control values for controlling the adjustable hybrid coupler of the second processing chain to be set at the fourth determined value of ZH;

determining, for the second processing chain, a fourth set of control values for controlling loads in reflective load circuitry of the second processing chain to be set at the fourth determined value of ZT;

storing said determined fourth set of control values for controlling the adjustable hybrid coupler in the second processing chain to be set at the determined fourth value of ZH; and storing said determined fourth set of control values for controlling loads in reflective load circuitry in the second processing chain to be set at the determined fourth value of ZT.

15. A method of operating a communications device, comprising:

receiving information indicating a beam direction to be used;

retrieving a first set of stored control signal setting information corresponding to the beam direction and a first signal processing chain to set an adjustable hybrid coupler in the first signal processing chain at a first desired value of ZH;

generating first control signals to be sent to the adjustable hybrid coupler of the first signal processing chain;

sending the generated first control signals to the adjustable hybrid coupler of the first signal processing chain;

configuring the adjustable hybrid coupler of the first signal processing chain based on the first received control signals; and operating the first signal processing chain to transmit or receive.

16. The method of claim 15, wherein the method is implemented by a system operating under the control of a controller.

17. The method of claim 16, further comprising, prior to operating the first signal processing chain to transmit or receive, performing the steps of:

retrieving a second set of stored control signal setting corresponding to the beam direction and the first signal processing chain to set adjustable loads in the first signal processing chain at a first desired value of ZT;

generating second control signals to be sent to the controllable reflective load circuitry of the first signal processing chain;

sending the generated second control signals to the controllable reflective load circuitry of the first signal processing chain; and configuring the reflective load circuits of the first signal processing chain based on the second received control signals.

18. The method of claim 17, further comprising:

retrieving a third set of stored control signal setting information corresponding to the beam direction and a second signal processing chain to set an adjustable hybrid coupler in the second signal processing chain at a second desired value of ZH;

generating third control signals to be sent to the adjustable hybrid coupler of the second signal processing chain;

sending the generated third control signals to the adjustable hybrid coupler of the second signal processing chain;

configuring the adjustable hybrid coupler of the second signal processing chain based on the third received control signals; and operating the second signal processing chain to transmit or receive.

19. The method of claim 15, further comprising:

determining that beam direction is to be changed.

20. The method of claim 19, further comprising:

receiving information indicating a new beam direction to be used.

* * * * *